US009352367B2

(12) United States Patent
Kaga et al.

(10) Patent No.: US 9,352,367 B2
(45) Date of Patent: May 31, 2016

(54) COLD ROLLED MATERIAL MANUFACTURING EQUIPMENT AND COLD ROLLING METHOD

(71) Applicant: PRIMETALS TECHNOLOGIES JAPAN, LTD., Tokyo (JP)

(72) Inventors: Shinichi Kaga, Tokyo (JP); Mitsuru Onose, Tokyo (JP); Noriaki Tominaga, Hiroshima (JP); Takehiko Saito, Hiroshima (JP); Yasutsugu Yoshimura, Tokyo (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 0 days.

(21) Appl. No.: 14/843,537

(22) Filed: Sep. 2, 2015

(65) Prior Publication Data

US 2015/0367391 A1 Dec. 24, 2015

Related U.S. Application Data

(62) Division of application No. 12/447,703, filed as application No. PCT/JP2006/323126 on Nov. 20, 2006, now Pat. No. 9,156,070.

(51) Int. Cl.
*B21B 1/28* (2006.01)
*B21B 15/00* (2006.01)
(Continued)

(52) U.S. Cl.
CPC ..... *B21B 1/28* (2013.01); *B21B 15/0085* (2013.01); *B21B 37/46* (2013.01); *B21B 1/22* (2013.01); *B21B 37/32* (2013.01); *B21B 37/38* (2013.01); *B21B 37/44* (2013.01); *B21B 37/48* (2013.01); *B21B 38/04* (2013.01); *B21B 2015/0014* (2013.01); *B21B 2015/0057* (2013.01); *B21B 2015/0064* (2013.01); *B21B 2275/06* (2013.01)

(58) Field of Classification Search
CPC ..... B21B 38/00; B21B 37/44; B21B 37/46; B21B 37/48; B21B 2015/0014; B21B 2015/0057; B21B 2015/0064; B21B 15/85; B21B 1/28; B21B 1/32; B21B 1/34; B21B 1/36
See application file for complete search history.

(56) References Cited

U.S. PATENT DOCUMENTS 3,938,360 A 2/1976 Shida et al.
4,485,497 A 12/1984 Miura
(Continued)

FOREIGN PATENT DOCUMENTS

CN 1225107 C 11/2005
CN 1226107 C 11/2005
(Continued)

*Primary Examiner* — Alexander P Taousakis
*Assistant Examiner* — Pradeep C Battula
(74) *Attorney, Agent, or Firm* — Birch, Stewart, Kolasch & Birch, LLP

(57) ABSTRACT

Cold rolled material manufacturing equipment includes: an unwinding device for unwinding a hot rolled coil after acid pickling; a joining device, disposed on the exit side of the unwinding device, for joining the tail end of a preceding coil to the leading end of a succeeding coil unwound from the unwinding device; a rolling mill for continuously rolling the coils in one direction; a strip storage device, disposed between the joining device and the rolling mill, for storing a strip to perform continuous rolling during the joining; a strip cutting device for cutting the strip to a desired length; a winding device for winding the rolled coil; a transport device for transporting the coil to the unwinding device so that the coil is rolled a plurality of times; and a rolling speed control device controlling a rolling speed during the joining to a speed lower than a steady rolling speed.

24 Claims, 15 Drawing Sheets

(51) Int. Cl.

| | |
|---|---|
| ***B21B 37/46*** | (2006.01) |
| *B21B 1/22* | (2006.01) |
| *B21B 37/32* | (2006.01) |
| *B21B 37/38* | (2006.01) |
| *B21B 37/44* | (2006.01) |
| *B21B 37/48* | (2006.01) |
| *B21B 38/04* | (2006.01) |

(56) References Cited

U.S. PATENT DOCUMENTS

| | | | |
|---|---|---|---|
| 5,495,736 | A | 3/1996 | Nishi et al. |
| 6,959,574 | B2 | 11/2005 | Nishi |
| 7,398,666 | B2 | 7/2008 | Denker |
| 7,937,978 | B2 | 5/2011 | Iwamoto |
| 9,156,070 | B2 * | 10/2015 | Kaga ..... B21B 1/28 |
| 2001/0037667 | A1 | 11/2001 | Leroux et al. |

FOREIGN PATENT DOCUMENTS

| | | | |
|---|---|---|---|
| FR | 2706793 | A1 | 12/1994 |
| JP | 54-43857 | A | 4/1979 |
| JP | 58-168410 | A | 10/1983 |
| JP | 60-152310 | A | 8/1985 |
| JP | 61-162203 | A | 7/1986 |
| JP | 10-58003 | A | 3/1998 |
| JP | 3322984 | B2 | 9/2002 |

* cited by examiner

〈 Shape Control Ranges in 4-High Rolling Mills 〉

〈 Shape Control Ranges in 6-High Rolling Mills 〉

COLD ROLLED MATERIAL MANUFACTURING EQUIPMENT AND COLD ROLLING METHOD

This application is a Divisional of application Ser. No. 12/447,703, filed on Jun. 26, 2009, now U.S. Pat. No. 9,156,070, which was filed as PCT International Application No. PCT/JP2006/323126 on Nov. 20, 2006, all of which are hereby expressly incorporated by reference into the present application.

BACKGROUND OF THE INVENTION

1. Field of the Invention

This invention relates to cold rolled material manufacturing equipment and a cold rolling method.

2. Description of the Related Art

Cold tandem mill equipment having a plurality of cold rolling mills, i.e., 3 or more cold rolling mills, arranged therein, or continuous cold tandem mill equipment having a joining device and a strip storage device disposed on the entry side of the cold tandem mill equipment to perform continuous rolling without stopping rolling (such equipment will be referred to hereinafter as TCM equipment) is put to practical use as equipment for mass-producing cold rolled materials in an annual production volume of more than 1,200,000 tons to 1,500,000 tons. Commercial use is also made of continuous pickling cold tandem mill equipment (hereinafter referred to as PL-TCM equipment) in which pickling equipment for removing scale of a hot rolled strip is disposed between the joining device and the strip storage device in the TCM equipment to continuously carry out a series of steps ranging from a pickling step to a rolling step.

On the other hand, reversing cold rolling equipment (hereinafter referred to as RCM equipment), in which one cold rolling mill is disposed, and a strip winding/unwinding device for performing both of winding and unwinding of a strip is disposed on each of the entry side and the exit side of the cold rolling mill, so that the strip is rolled and reversely rolled between the winding/unwinding devices on the entry side and the exit side of the cold rolling mill until the strip reaches a desired strip thickness, finds practical use as rolling equipment for producing cold rolled materials in many types of steels and in annual production volumes as small as 300,000 tons.

To increase the annual production volume of the RCM equipment composed of one rolling mill as described above, a reversing small-sized rolling apparatus for cold rolling a strip-shaped rolling material (see Patent Document 1), for example, is known as equipment for producing cold rolled materials in an annual production volume of the order of 500,000 tons to 600,000 tons with the use of two rolling mills (hereinafter referred to as 2-stand reverse equipment).

Patent Document 1: Japanese Patent No. 3322984

Patent Document 2: JP-A-61-162203

DISCLOSURE OF THE INVENTION

Problems to be Solved by the Invention

In recent years, there have been increases in hot rolling equipment, which performs medium-scale production in an annual production volume of the order of 1,000,000 tons to 2,000,000 tons, by introducing hot rolling equipment having thin slab continuous casting equipment and a plurality of hot rolling mills continuously arranged in hot rolling upstream of cold rolling. There has been an increasing need for equipment which cold-rolls hot rolled materials in an annual production volume of the order of 600,000 tons to 900,000 tons among hot rolled materials produced by such hot rolling equipment.

In a process for producing cold rolled materials of many steel types, too, there has been an increasing demand for medium-scale manufacturing equipment providing an annual production volume of the order of 600,000 tons to 900,000 tons.

If the TCM or PL-TCM equipment, which comprises a row of three or more rolling mills providing an annual production volume of more than 1,200,000 tons to 1,500,000 tons, is used as this medium-scale manufacturing equipment, the production volume is too low for the capability of the equipment, and an investment in and expenses for the equipment are too great for the production volume. As a result, the amount of investment recovery per unit production volume of the cold rolled materials has increased, posing the problem that the price of the product becomes high.

With the PL-TCM equipment, moreover, the pickling step and the rolling step are continuous with each other. In order not to stop pickling and rolling during a joining operation in the joining device on the entry side of the pickling device, therefore, a large-sized storage device for a strip is needed on each of the entry side and the exit side of the pickling device. Furthermore, the total length of the strip in the range from the unwinding device to the winding device, including the large-sized strip storage device, is as large as about 1 to 2 km. Thus, there has been the problem that once the strip breaks in the line, a lengthy time is required for the passage of the strip.

To produce 600,000 tons to 900,000 tons annually in the RCM equipment, it is necessary to provide 2 to 3 or more stands. This has posed the problem of increased expenses for the introduction and maintenance of the equipment. In addition, in an initial pass and a second pass during rolling, the leading end of the strip is wound round the drum of the winding/unwinding device disposed on each of the entry side and the exit side of the cold rolling mill. For this purpose, an operator for assisting in a pas sage operation is needed. Compared with the full-automated TCM equipment, many workers are required, resulting in high labor costs.

In the RCM equipment, moreover, in order to avoid warpage of the strip in the initial pass and the second pass during rolling, the leading end of the strip is passed in the unrolled state. Even in the third and later passes, the portion to be passed and rolled has to be retained in the unrolled state at the site of pass switching. Thus, unrolled portions at the leading end and tail end of the strip deviate from the sheet or strip thickness (collectively called the strip thickness) range of the product, posing the problem that the rolled strip cannot be sold as a product. Such strips falling outside the product strip thickness are called off-gage.

In connection with the off-gage, the volume of the off-gage is expressed as its rate to the total production volume, and this rate is defined as the off-gage rate. The off-gage rate in each rolling equipment is of the order of about 0.2% for the TCM equipment and the PL-TCM equipment, of the order of about 2.5% for the RCM equipment, and of the order of about 6.0% for the two-stand reverse equipment.

With the equipment of the reversing rolling type, a very high off-gage rate of the order of about 2.5% to 6.0% is the most annoying problem. The two-stand reverse equipment described in Patent Document 1, in particular, involves the problems that off-gage reaching a rate of the order of about 6.0% occurs, the yield is considerably low, and the cost of production markedly increases. This equipment is not suitable for medium-scale production.

In cold rolling equipment composed of a single cold rolling mill which produces a volume of the order of 300,000 tons as an annual output, an attempt is made to decrease the off-gage rate. This attempt uses equipment in which the leading end and tail end of a coiled strip or coil are joined together, and the coil is circulated so that the strip is rolled a plurality of times continuously in one direction. As this equipment, continuous single-stand cold rolling equipment is shown (see Patent Document 2).

The continuous single-stand cold rolling equipment has a production volume of the order of 300,000 tons/year, and is thus unsuitable for medium-scale production with an annual output of the order of 600,000 to 900,000 tons. This equipment is expected to show the effect of decreasing the off-gage rate. Compared with the RCM equipment, however, various devices are added, such as an unwinding device, a joining device, a large-sized strip storage device, a rotary shear, a carrousel coiler or two winding devices, and a coil circulating device for circulating the coil from the coiler to the unwinding device. This has caused the problem of entailing huge costs for equipment introduction. With the production scale involving an annual production volume of the order of 300,000 tons, the absolute value of a profit obtained by a yield increase due to a decrease in the off-gage rate, and by an increase in the production capacity ascribed to continuous rolling, has been low for the amount of investment. As a result, costs for recovering the invested amount have increased, but this has not been a realistic solution.

The continuous single-stand cold rolling equipment, like the TCM equipment and the PL-TCM equipment, needs a large-sized strip storage device intended not to stop rolling during joining. The total length of the strip ranging from the unwinding device to the winding device, including the large-sized strip storage device, is as large as about 1 to 3 km. Once the strip breaks within the line, therefore, the problem occurs that a lengthy time is required for the passage of the strip.

Furthermore, the method used is to circulate the coil through the single stand, and perform joining and rolling a plurality of times, thereby obtaining a desired strip thickness. Thus, the range of the strip thickness at the leading and tail ends of the coil to be joined expands to a range from 6 mm at a maximum to 0.1 mm at a minimum. If a flash butt welder (hereinafter referred to as FBW) or a laser beam welder (hereinafter referred to as LBW) is applied, joining of plates with a thickness of 1.6 mm or less is difficult with FBW because of a problem such as buckling. Even incase LBW is applied, butts in a broad strip thickness range of 0.1 mm to 6 mm cannot be joined together by a single joining device. A plurality of expensive joining devices are required in conformity with the strip thickness range, thus incurring immense expenses for introduction of equipment.

According to the results in the PL-TCM equipment, if there is a difference in the strip thickness between the tail end of the preceding coil and the leading end of the succeeding coil, a step is formed at the site of joining, even with the use of FBW and LBW. Thus, an impact force acts at the time of rolling, thereby dramatically increasing the probability of breakage at the junction (i.e., the site of joining). Hence, the strip thickness difference is limited to within 1 mm, and the strip thickness ratio is limited to within 1:1.5, in carrying out rolling. Even this method has not been successful in solving the problem that the junction of the strip breaks during rolling with a frequency of once in every 1000 operations.

The method of joining with butts being in contact requires a very high accuracy at the site of cutting at the leading end and tail end of the coil. Outside the range of this accuracy, the plate breakage rate of the rolled material noticeably increases. This has been a main factor for decreased reliability. Once the plate breaks, it takes plenty of time to restore operation. Thus, the improvement of reliability of the junction has become a challenge.

A mash seam welder (hereinafter referred to as MSW) of the type in which strips are lapped and joined is relatively inexpensive. However, joining of the strips with strip thicknesses of 4.5 mm or more is regarded as difficult with MSW. In the case of cold rolling presenting the amount of rolling reduction, at the junction, of 50% or more of the strip thickness of the base material, a diffusion joining portion formed at the nugget margin opens in the form of cracks as a result of rolling. Because of an increase in the stress concentration factor, the probability of breakage at the junction sharply increases. Thus, the application of MSW to equipment for cold rolling involving a rolling reduction amount of 10% or more has been avoided.

With the method of circulating the coil through the single stand, and performing joining and rolling a plurality of times, the number of times that joining is performed needs to be the number of times rolling is carried out. Compared with the number of times joining is performed in TCM, the number of times joining is carried out with this method increases to a 4- to 6-fold level. Moreover, the number of coils circulated is a very large number equivalent to the number of the coil products multiplied by the number of times rolling is performed.

Furthermore, the range of the strip thickness of strips to be joined expands to 0.1 mm to 6 mm as stated earlier. In order to roll the point of joining at an ordinary rolling speed without causing breakage to the junction, therefore, there is no choice but to operate the coil within the restrictions imposed on the strip thickness difference and the strip thickness ratio of the plates to be joined. Besides, an increase in the frequency of breakage at the junction is expected in accordance with an increase in the number of times joining is performed. This has posed the challenges of decreasing the number of times joining is performed, and enhancing the reliability of the junction.

The above-described problems have remained unsolved in the continuous single-stand cold rolling equipment described in Patent Document 2.

The present invention has been proposed in the light of the above-mentioned various problems. It is an object of the invention to provide cold rolled material manufacturing equipment and a cold rolling method, which give a high yield, have a high production capacity, and excel in cost effectiveness, in medium-scale production facilities with an annual production volume of the order of 600,000 to 900,000 tons.

Means for Solving the Problems

A cold rolling method according to a first aspect of the invention, intended for solving the above problems, comprises: a joining step of joining a tail end of a preceding coil to a leading end of a succeeding coil by a joining device disposed on an exit side of an unwinding device for unwinding a hot rolled coil after acid pickling, the succeeding coil having been unwound from the unwinding device; a rolling step of continuously rolling the coils, with the leading end and the tail end of the coils being joined, in one direction by a rolling mill or a plurality of rolling mills; a cutting step of cutting a rolled strip to a desired length by a cutting device disposed between the rolling mill and a winding device; a winding step of winding the rolled coil by the winding device; and a transport step of withdrawing the coil from the winding device, and transporting the withdrawn coil to the unwinding device, and is characterized in that in the joining step, a rolling speed during joining of the tail end of the preceding coil to the leading end of the succeeding coil is rendered a lower speed than a steady rolling speed, and that these steps are repeated a plurality of times until the coil reaches a desired product strip thickness.

A cold rolling method according to a second aspect of the invention, intended for solving the above problems, is the cold rolling method according to the first aspect of the invention, characterized in that the rolling speed during joining of the tail end of the preceding coil to the leading end of the succeeding coil exceeds 0 mpm, but is not higher than 50 mpm.

A cold rolling method according to a third aspect of the invention, intended for solving the above problems, is the cold rolling method according to the first or second aspect of the invention, characterized in that if a ratio between strip thicknesses of the tail end of the preceding coil and the leading end of the succeeding coil to be joined exceeds 1:1.5, or if a difference between the strip thicknesses of the coils exceeds 1 mm, an amount of rolling reduction at a junction and in a vicinity of the junction is rendered smaller than an amount of rolling reduction in a steady rolling portion by on-the-fly gage changing, and the rolling speed at the junction and in the vicinity of the junction exceeds 0 mpm, but is not higher than 50 mpm.

A cold rolling method according to a fourth aspect of the invention, intended for solving the above problems, is the cold rolling method according to any one of the first to third aspects of the invention, characterized in that if an amount of rolling reduction at a junction exceeds a predetermined value, the amount of rolling reduction at the junction and in a vicinity of the junction is rendered smaller than an amount of rolling reduction in a steady rolling portion by on-the-fly gage changing.

A cold rolling method according to a fifth aspect of the invention, intended for solving the above problems, is the cold rolling method according to the fourth aspect of the invention, characterized in that a rolling speed at the junction and in the vicinity of the junction exceeds 0 mpm, but is not higher than 50 mpm.

A cold rolling method according to a sixth aspect of the invention, intended for solving the above problems, is the cold rolling method according to any one of the first to fifth aspects of the invention, characterized in that after the tail end of the preceding coil departs from the unwinding device, the rolling speed is rendered a desired speed or lower, and with the rolling speed being maintained, a strip stored beforehand in a strip storage device disposed between the unwinding device and the rolling mill is paid out, until the succeeding coil is inserted into the unwinding device, unwound at a higher speed than the rolling speed, and allowed to catch up with the preceding coil at the joining device, and joining of these coils is completed.

A cold rolling method according to a seventh aspect of the invention, intended for solving the above problems, is the cold rolling method according to any one of the first to sixth aspects of the invention, characterized by cutting the strip by the cutting device, rendering the rolling speed equal to or lower than a desired speed, withdrawing the coil from the winding device, and guiding a leading end of a succeeding coil to the winding device by a guide device disposed between the cutting device and the winding device.

A cold rolling method according to an eighth aspect of the invention, intended for solving the above problems, is the cold rolling method according to any one of the first to seventh aspects of the invention, characterized by measuring an entry-side rolling speed, an entry-side strip thickness, and an exit-side rolling speed of the rolling mill; computing a strip thickness directly below a work roll of the rolling mill based on measured values of the measurements; and controlling the strip thickness to a desired strip thickness by a hydraulic roll gap control device which the rolling mill has.

A cold rolling method according to a ninth aspect of the invention, intended for solving the above problems, is the cold rolling method according to any one of the first to eighth aspects of the invention, characterized by controlling a strip shape by one or both of roll bender control and coolant control based on results of computation of roll deflection due to a change in a rolling load of the rolling mill.

A cold rolling method according to a tenth aspect of the invention, intended for solving the above problems, is the cold rolling method according to any one of the first to ninth aspects of the invention, characterized by incorporating tension, which has been generated by tension generating devices disposed on an entry side and an exit side of the rolling mill, into gage control to exercise tension control so as to attain a desired strip thickness.

A cold rolling method according to an eleventh aspect of the invention, intended for solving the above problems, is the cold rolling method according to any one of the first to tenth aspects of the invention, characterized by joining a plurality of the coils in a first pass to forma built-up coil; rolling the built-up coil in a second pass to a pass before a final pass, without dividing the built-up coil into a desired coil length; and dividing the rolled built-up coil into the desired coil length in the final pass by the cutting device disposed on an exit side of the rolling mill.

Cold rolled material manufacturing equipment according to a twelfth aspect of the invention, intended for solving the above problems, comprises an unwinding device for unwinding a hot rolled coil after acid pickling; joining means, disposed on an exit side of the unwinding device, for joining a tail end of a preceding coil to a leading end of a succeeding coil unwound from the unwinding device; a rolling mill or a plurality of rolling mills for continuously rolling the coils, with the leading end of the coil and the tail end of the coil being joined, in one direction; a strip storage device, disposed between the joining means and the rolling mill, for storing a strip in order to perform continuous rolling by the rolling mill during joining of the preceding coil and the succeeding coil by the joining means; a strip cutting device, disposed on an exit side of the rolling mill, for cutting the strip to a desired length; a winding device for winding the rolled coil; transport means for withdrawing the coil from the winding device, and transporting the withdrawn coil to the unwinding device so that the coil is rolled a plurality of times until a strip thickness of the coil reaches a desired product strip thickness; and a rolling speed control device for controlling a rolling speed during joining of the tail end of the preceding coil to the leading end of the succeeding coil to a lower speed than a steady rolling speed.

Cold rolled material manufacturing equipment according to a thirteenth aspect of the invention, intended for solving the above problems, is the cold rolled material manufacturing equipment according to the twelfth aspect of the invention, characterized in that the rolling speed control device is a control device capable of controlling the rolling speed to a rolling speed which exceeds 0 mpm, but is not higher than 50 mpm.

Cold rolled material manufacturing equipment according to a fourteenth aspect of the invention, intended for solving the above problems, is the cold rolled material manufacturing equipment according to the twelfth or thirteenth aspect of the invention, characterized in that the strip storage device stores the strip with a length of 100 m or less.

Cold rolled material manufacturing equipment according to a fifteenth aspect of the invention, intended for solving the above problems, is the cold rolled material manufacturing equipment according to any one of the twelfth to fourteenth aspects of the invention, characterized in that tension generating devices are disposed on an entry side and the exit side of the rolling mill.

Cold rolled material manufacturing equipment according to a sixteenth aspect of the invention, intended for solving the above problems, is the cold rolled material manufacturing equipment according to any one of the twelfth to fifteenth aspects of the invention, characterized in that the rolling mill is a six-high mill.

Cold rolled material manufacturing equipment according to a seventeenth aspect of the invention, intended for solving the above problems, is the cold rolled material manufacturing equipment according to any one of the twelfth to sixteenth aspects of the invention, characterized in that the unwinding device and the winding device are disposed adjacently.

Cold rolled material manufacturing equipment according to an eighteenth aspect of the invention, intended for solving the above problems, is the cold rolled material manufacturing equipment according to any one of the twelfth to seventeenth aspects of the invention, characterized in that two of the unwinding devices are provided.

Cold rolled material manufacturing equipment according to a nineteenth aspect of the invention, intended for solving the above problems, is the cold rolled material manufacturing equipment according to any one of the twelfth to seventeenth aspects of the invention, characterized in that the unwinding device is a single unwinding device, and that the rolling speed control device is a control device which controls the rolling speed to a speed exceeding 0 mpm, but not higher than 50 mpm, from a time when the tail end of the preceding coil departs from the unwinding device until the succeeding coil inserted into the unwinding device is unwound at a higher speed than the rolling speed, and joining of the preceding coil and the succeeding coil by the joining device is completed, with the strip stored beforehand in the strip storage device being paid out.

Cold rolled material manufacturing equipment according to a twentieth aspect of the invention, intended for solving the above problems, is the cold rolled material manufacturing equipment according to any one of the twelfth to nineteenth aspects of the invention, further comprising the winding device as a single winding device; a coil withdrawing device, disposed in the vicinity of the winding device, for withdrawing the coil from the winding device; and a strip guide device, disposed between the strip cutting device and the winding device, for guiding a leading end of a succeeding coil to the winding device, and wherein the rolling speed control device is a control device for controlling the rolling speed to a speed exceeding 0 mpm, but not higher than 50 mpm, from a time when the strip is cut by the strip cutting device until the leading end of the succeeding coil is guided to the winding device by the strip guide device.

Cold rolled material manufacturing equipment according to a twenty-first aspect of the invention, intended for solving the above problems, is the cold rolled material manufacturing equipment according to any one of the twelfth to nineteenth aspects of the invention, characterized in that the winding device is a carrousel reel or two tension reels.

Cold rolled material manufacturing equipment according to a twenty-second aspect of the invention, intended for solving the above problems, is the cold rolled material manufacturing equipment according to any one of the twelfth to twenty-first aspects of the invention, characterized in that the joining device is a mash seam welder, if a strip thickness of the strip is 4.5 mm or less.

Cold rolled material manufacturing equipment according to a twenty-third aspect of the invention, intended for solving the above problems, is the cold rolled material manufacturing equipment according to any one of the twelfth to twenty-first aspects of the invention, characterized in that if the cold rolled material is a non-ferrous metal such as an aluminum alloy, a copper alloy, or a magnesium alloy, the joining device is a friction stir welder.

Cold rolled material manufacturing equipment according to a twenty-fourth aspect of the invention, intended for solving the above problems, is the cold rolled material manufacturing equipment according to any one of the twelfth to twenty-third aspects of the invention, characterized in that two of the rolling mills are provided.

Effects of the Invention

According to the present invention, cold rolled material manufacturing equipment and a cold rolling method having a high efficiency, a high yield, and excellent cost performance can be provided in medium-scale production facilities having an annual production volume of the order of 600,000 to 900,000 tons.

DESCRIPTION OF THE NUMERALS AND SYMBOLS

Figure 1:
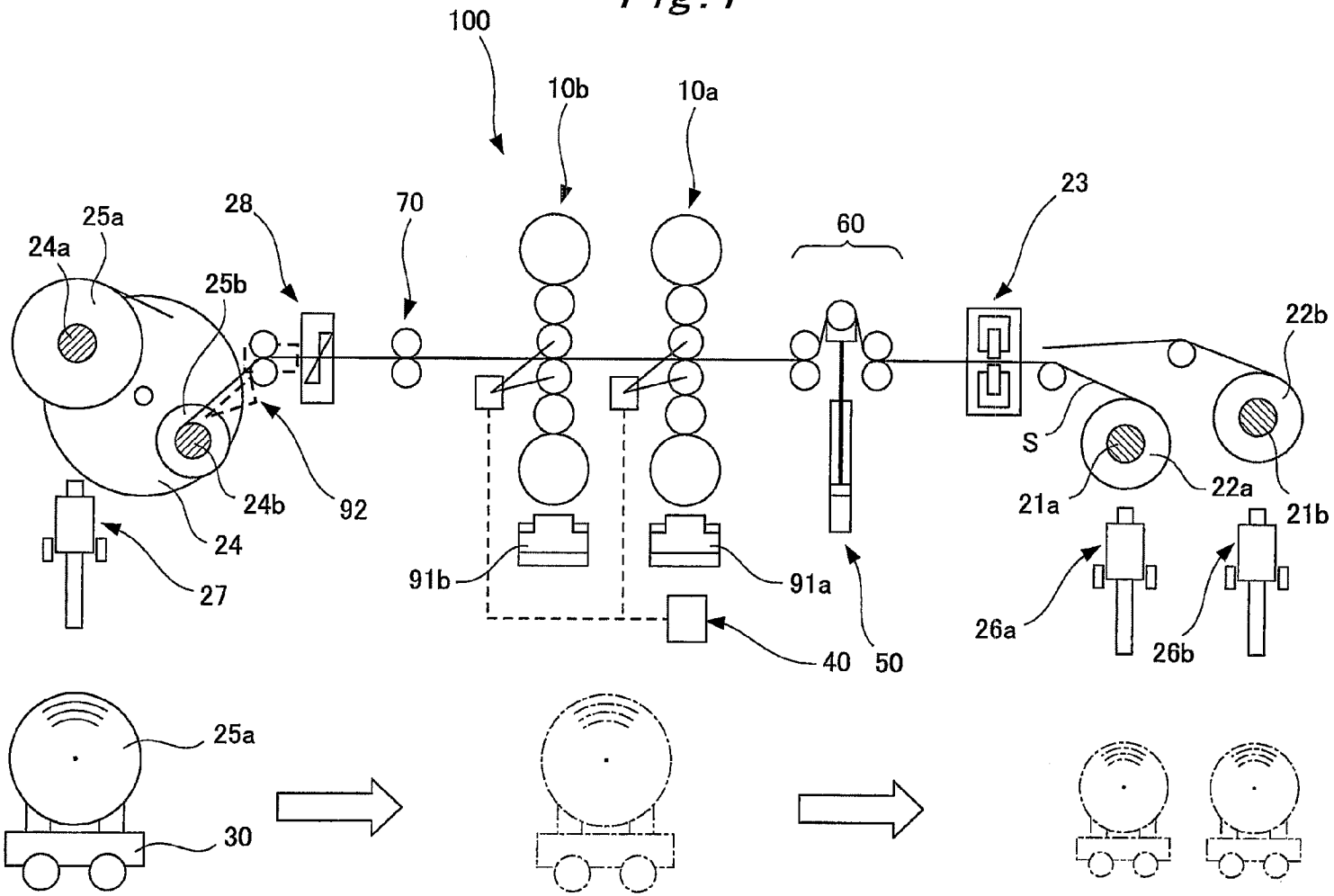
FIG. 1 is a schematic front view of cold rolled material manufacturing equipment according to the best mode for carrying out the present invention.

10*a*, 10*b* rolling mill, 21*a*, 21*b* coil unwinding device, 22*a*, 22*b*, 25*a*, 25*b*, 203*a*, 203*b* coil, 23 joining device, 24, 201*a*, 201*b* coil winding device, 26*a*, 26*b* entry-side coil car, 27, 202*a*, 202*b* exit-side coil car, 28 strip cutting device, 30 coil transport device, 40 rolling speed control device, 50 strip storage device, 60, 70 tension generating device, 91*a*, 91*b* hydraulic roll gap control device, 92 guide device, 100, 110, 120, 200, 210, 300, 400, 410 cold rolled material manufacturing equipment, 401 snaking control device, 402, 403, 404 tension generating device, 405 guide roller, S strip.

DETAILED DESCRIPTION OF THE INVENTION

The actions of the cold rolled material manufacturing equipment and the cold rolling method according to each embodiment of the present invention will be described below.

The rolling speed during joining of the tail end of the preceding coil and the leading end of the succeeding coil is rendered lower than the steady rolling speed. As a result, the length of the strip stored in the strip storage device disposed between the joining device and the rolling mill is shortened, and the strip storage device is downsized.

Under low speed rolling conditions, according to a strip thickness control (or gage control) method in which the strip thickness is measured by a gage meter installed on the exit side of the rolling mill, and is modified based on the deviation between the strip thickness command value and the actual strip thickness value, the accuracy of strip thickness control (gage control) declines due to a time lag from rolling directly below work rolls of the rolling mill until detection of the strip thickness. Under the low speed rolling conditions, therefore, the entry-side rolling speed, the entry-side strip thickness, and the exit-side rolling speed are measured. Based on these measured values, the strip thickness directly below the work rolls of the rolling mill is computed, and gage control is exercised such that the desired strip thickness is achieved by the hydraulic roll gap control device possessed by the rolling mill. By so doing, the strip thickness is controlled without delay, and the accuracy of gage control is ensured.

Likewise, under the low speed rolling conditions, according to a shape control method in which the shape of the strip is measured by a shape meter installed on the exit side of the rolling mill, and is modified based on the deviation between the shape command value and the actual shape value, the accuracy of shape control declines due to a time lag. Thus, changes in the rolling load of the rolling mill are detected and, based on the results of computation of roll deflection associated with such changes, the strip shape is controlled by roll bender control or coolant control or both these controls without delay. By this measure, shape control accuracy is ensured. By using a six-high rolling mill as the above rolling mill, moreover, the amounts of changes in deflection of the work roll and the backup roll associated with changes in the rolling load are markedly curtailed compared with the conventional four-high rolling mill or the like. As a result, changes in the strip shape during speed change are minimized.

Under the low speed rolling conditions, the coefficient of friction between the work roll and the strip may increase to increase the rolling load. Thus, tension generated by the tension generating devices disposed on the entry side and exit side of the rolling mill is incorporated into gage control, whereby the tension is controlled to achieve the desired strip thickness. By so doing, an increase in the rolling load is curbed.

According to the results in the PL-TCM equipment, if a difference in strip thickness exists between the tail end of the preceding coil and the leading end of the succeeding coil, a step is formed at the site of joining, even with the use of FBW and LBW. This poses the problem that an impact force acts during rolling, dramatically increasing the probability of the junction breaking. Thus, rolling is carried out, with the strip thickness difference being limited to within 1 mm, and the strip thickness ratio being limited to within 1:1.5. However, the strip junction may break during rolling with a frequency of once in every 1,000 rolling operations, and this problem remains unsolved in some cases. In such cases, if the joining conditions and the rolling conditions have a high probability of breakage, although the joining conditions involve the above strip thickness limitations, the amount of rolling reduction at the junction and in the vicinity of the junction is rendered smaller than the amount of rolling reduction at the steady rolling portion by on-the-fly gage changing. This measure further reduces the probability of breakage of the junction. Furthermore, the rolling speed at the junction and in the vicinity of the junction is set to exceed 0 mpm, but be not higher than 50 mpm. By this measure, the range of on-the-fly gage changing which causes off-gage is minimized.

Moreover, if, at the junction, the strip thickness ratio between the tail end of the preceding coil and the leading end of the succeeding coil to be joined exceeds 1:1.5, or the strip thickness difference between them exceeds 1 mm, rolling of the junction has so far been impossible. The amount of rolling reduction at this junction and in the vicinity of the junction is rendered smaller than the amount of rolling reduction at the steady rolling portion by on-the-fly gage changing. In addition, the rolling speed at the junction and in the vicinity of the junction is set to exceed 0 mpm, but be not higher than 50 mpm. By this measure, the impact force during rolling at the junction is diminished, and the desired joining strength is maintained. Besides, the restrictions on the thicknesses of the plates to be joined are relaxed, and the restrictions on coil operation, such as the sequence of the coils subjected to rolling, are markedly lightened.

The method of joining with butts being in contact, such as in LBW or FBW, requires a very high accuracy at the site of cutting at the leading end and tail end of the coil. Outside the range of this accuracy, the breakage rate of the junction of the rolled material noticeably increases. This results in decreased reliability.

MSW adopts a method in which strips are lapped and joined. Thus, unlike a joining device of the butt joining type, MSW is excellent in joining thin materials with a thickness of 2 mm or less. In cold rolling in which the amount of rolling reduction at the junction is 50% or more of the strip thickness of the base material, however, a diffusion joining portion formed at the nugget margin opens in the form of cracks as a result of rolling. Because of an increase in the stress concentration factor, the probability of breakage at the junction sharply increases. However, the use of the above-mentioned junction rolling method enables MSW to be applied to cold rolling equipment.

In the first pass, a plurality of coils are joined to forma built-up coil. In the second pass to the pass before the final pass, the built-up coil is rolled, without being divided into desired coil lengths. In the final pass, the rolled built-up coil is divided into the desired coil lengths by the cutting device disposed on the exit side of the rolling mill. By so doing, the number of times joining is performed, the number of times cutting is carried out, and the number of coils circulated are reduced.

The unwinding device and the winding device are disposed adjacently, whereby the coil transport device is downsized to shorten a tact time for coil transport.

If the desired annual production volume is relatively small, after or simultaneously with the withdrawal of the tail end of the preceding coil from the unwinding device, the rolling speed is rendered the desired speed or lower, and the succeeding coil is inserted into the unwinding device, is unwound at a higher speed than the above rolling speed, and is allowed to catch up with the preceding coil at the joining device. Until joining of these coils is completed, the above rolling speed is maintained, and the strip stored beforehand in the strip storage device disposed between the unwinding device and the rolling mill is paid out. In this manner, one unwinding device is adopted.

If the desired annual production volume is relatively small, after or simultaneously with cutting of the strip by the cutting device, the rolling speed is rendered equal to or lower than the desired speed, the coil is withdrawn from the winding device, and the leading end of the succeeding coil is guided to the winding device by the guide device disposed between the cutting device and the winding device. In this manner, one winding device is adopted.

To enhance the production capacity of the equipment, two of the unwinding devices are used, or the winding device is rendered a carrousel reel or two tension reels. By this means, necessary time for winding and unwinding is shortened.

To roll a non-ferrous metal such as an aluminum alloy, a copper alloy, or a magnesium alloy, a friction stir welder is used as the joining device. By so doing, the reliability of the junction is enhanced inexpensively.

If a production volume of the order of 600,000 tons to 900,000 tons/year is needed, two of the rolling mills are adopted. By so doing, the number of times the coil is circulated is decreased. Moreover, the tension of the strip between the rolling mills is increased by the output of the main motor of the rolling mill during low speed rolling to curtail the amount of an increase in the rolling load due to an increase in the coefficient of friction between the work roll and the strip. Similarly, even during stead rolling, the strip tension between the roll ing mills is increased to reduce the number of times rolling is carried out.

Next, the cold rolled material manufacturing equipments according to embodiments of the present invention will be described with reference to the accompanying drawings. A cold rolled steel plate is taken as an example of the cold rolled material in these embodiments for the purpose of illustration.

Figure 2:
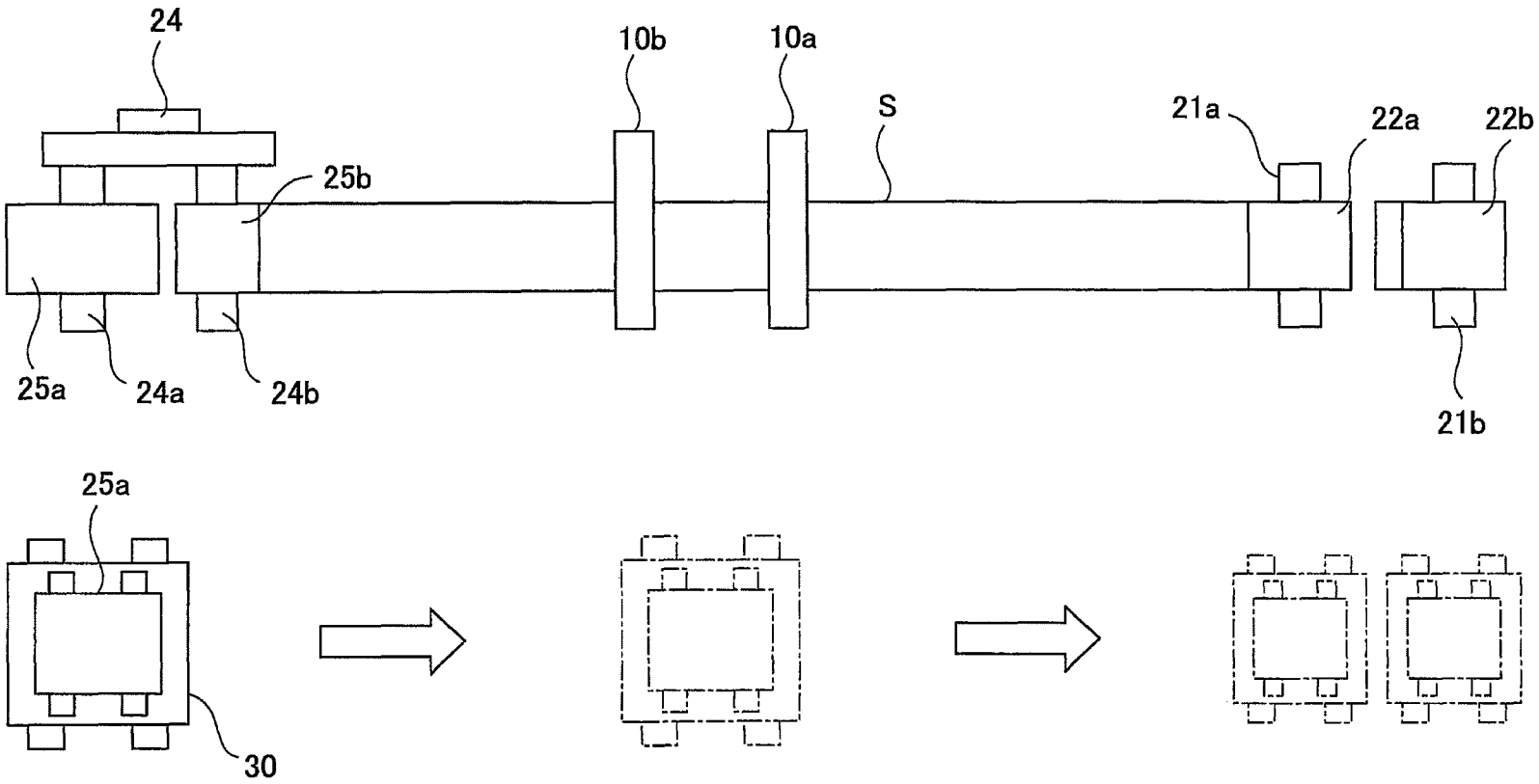
FIG. 2 is a schematic plan view of the cold rolled material manufacturing equipment according to the best mode for carrying out the present invention.
Figure 3A:
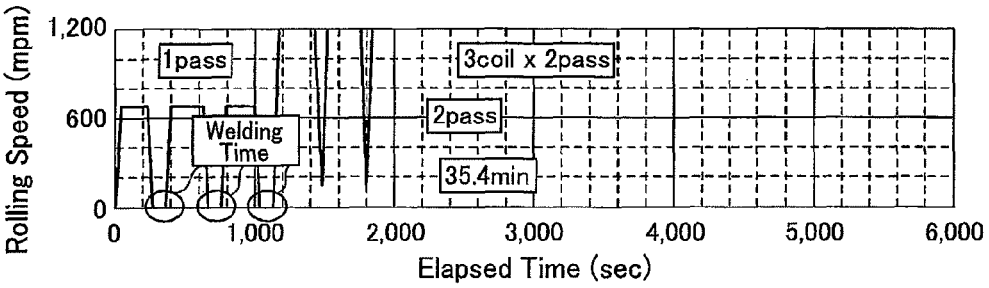
FIG. 3*a* is a time-chart showing the relationship between the elapsed time and the rolling speed in the cold rolled material manufacturing equipment according to the best mode for carrying out the present invention.
Figure 3B:
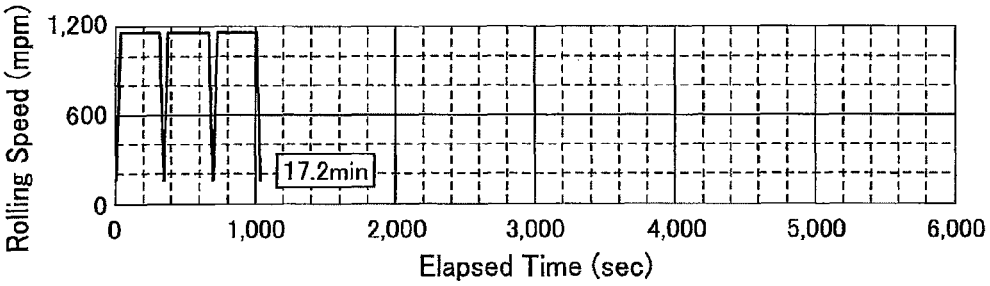
FIG. 3*b* is a time-chart showing the relationship between the elapsed time and the rolling speed in TCM equipment having four rolling mills.
Figure 3C:
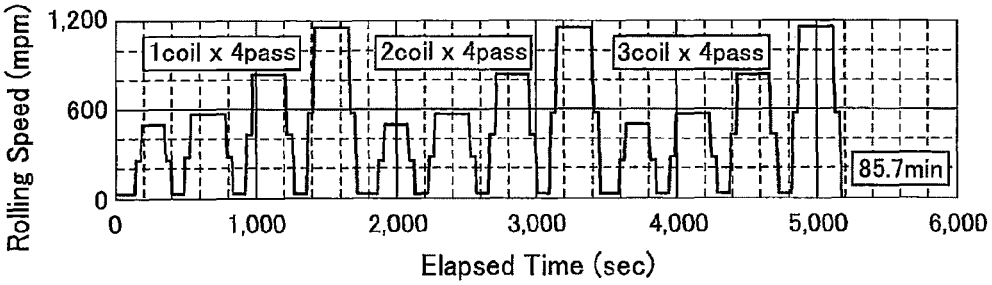
FIG. 3*c* is a time-chart showing the relationship between the elapsed time and the rolling speed in RCM equipment with one rolling mill.
Figure 3D:
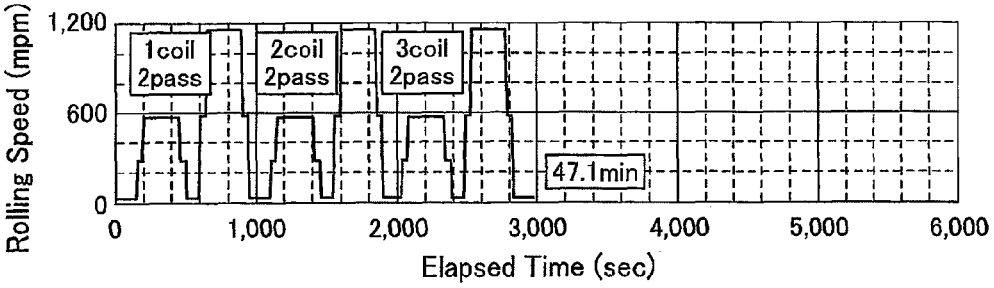
FIG. 3*d* is a time-chart showing the relationship between the elapsed time and the rolling speed in 2-stand reverse equipment.
Figure 4:
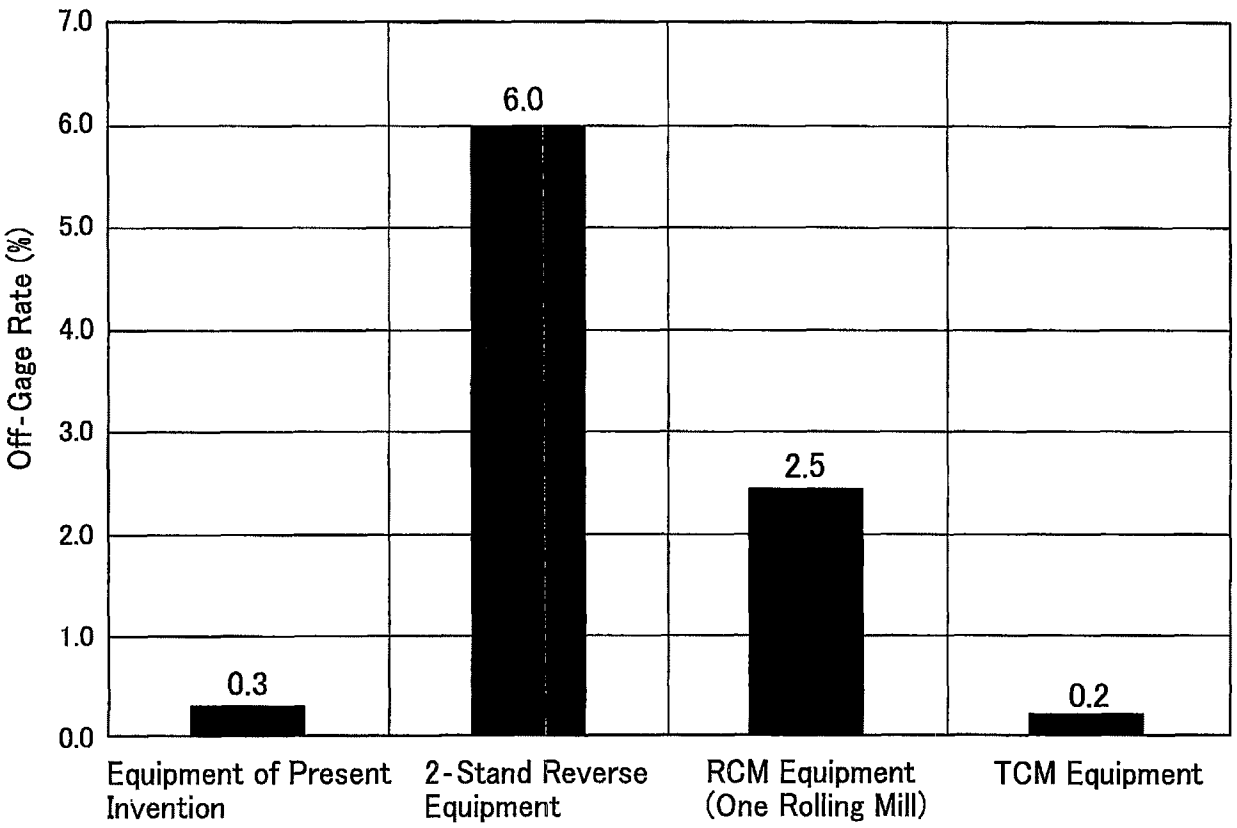
FIG. 4 is a graph showing the off-gage rate in each cold rolled material manufacturing equipment.

FIG. 1 is a schematic front view of cold rolled material manufacturing equipment according to the best mode for carrying out the present invention. FIG. 2 is a schematic plan view of the equipment. FIGS. 3*a*, 3*b*, 3*c* and 3*d* are each a time-chart showing the relationship between the elapsed time and the rolling speed in each cold rolled material manufacturing equipment. FIG. 4 is a graph showing the off-gage rate in each cold rolled material manufacturing equipment. FIGS. 5 to 8 are each a graph showing the shape control ranges of four-high rolling mills and six-high rolling mills at a steady rolling speed and a low rolling speed.

If an annual production volume of the order of 600,000 tons to 900,000 tons is assumed, a plurality of rolling mills are arranged in cold rolled material manufacturing equipment 100. In the present embodiment, two rolling mills, 10*a* and 10*b*, are arranged.

As shown in FIG. 1, the cold rolled material manufacturing equipment 100 comprises two coil unwinding devices 21*a*, 21*b* for unwinding hot rolled coils 22*a*, 22*b* after acid pickling; a joining device (joining means) 23 disposed, on the exit side of the coil unwinding devices 21*a*, 21*b*, for joining the tail end of a preceding coil 25*b* to the leading end of the succeeding coil 22*a* or 22*b* unwound from the unwinding device 21*a* or 21*b*; two rolling mills, i.e., a first rolling mill 10*a* and a second rolling mill 10*b*, as rolling mills for continuously cold rolling a strip S in one direction, the strip S having the leading end of the coil and the tail end of the coil joined together; a strip storage device 50 disposed, between the joining device 23 and the first rolling mill 10*a*, for storing the strip S so that rolling by the rolling mills 10*a*, 10*b* is performed continuously during joining of the preceding coil 25*b* and the succeeding coil 22*a* or 22*b* by the joining device 23; a strip cutting device 28 disposed, on the exit side of the second rolling mill 10*b*, for cutting the rolled strip to a desired length; a carrousel reel 24 which is a coil winding device for winding the strip; a coil transport device (transport means) 30 for withdrawing a coil 25*a* from the coil winding device 24 and transporting the coil 25*a* to the coil unwinding devices 21*a*, 21*b* so that the coil 25*a* is rolled a plurality of times until the strip thickness of the coil 25*a* reaches a desired product strip thickness; and a rolling speed control device 40 for controlling the rolling speed during joining of the tail end of the preceding coil 25*b* and the leading end of the succeeding coil 22*a* or 22*b* to a lower speed than a steady rolling speed.

The above-mentioned hot rolled coils 22*a*, 22*b* after acid pickling are inserted into the coil unwinding devices 21*a*, 21*b*, respectively, by entry-side coil cars 26*a*, 26*b*. The rolled coils 25*a*, 25*b* are withdrawn by an exit-side coil car 27.

The rolling speed control device 40 is a control device capable of controlling the rolling speed to a rolling speed which exceeds 0 mpm, but is not higher than 50 mpm; preferably, exceeds 0 mpm, but is not higher than 25 mpm; more preferably, exceeds 0 mpm, but is not higher than 10 mpm; still more preferably, exceeds 0 mpm, but is not higher than 5 mpm; and further preferably, exceeds 0 mpm, but is not higher than 2 mpm.

Because of these features, the length of the strip stored in the strip storage device 50 can be shortened, the length of the entire equipment can be shortened, and the construction cost of the equipment can be reduced. Furthermore, an impact force at the time of rolling the junction can be diminished, and the desired joining strength can be maintained. Also, restrictions on the thicknesses of the plates joined can be lightened, and restrictions on coil operation such as the sequence of the coils subjected to rolling can be markedly relaxed. Moreover, the off-gage length at the time of on-the-fly gage changing can be shortened.

Generally, however, when the same product strip thickness as in the steady rolling speed region is to be obtained by low speed rolling, the coefficient of friction between the work roll and the strip may increase, and the rolling load may be increased according to the type of the steel of the strip and the deformation resistance of the strip. If the amount of this increase is not within the rated load of the rolling mill, it is necessary to adopt a large-sized rolling mill increased in rated load. This results in the problem of increasing the cost of introducing the equipment.

Under these situations, studies using ordinary steel were conducted on the confirmation of rolling load increases in the low speed region at 50 mpm or less, and how to decrease the rolling load. In connection with correlation among the number of passes, the rolling speed, and the rolling load, the base material was rolled in a maximum of 10 passes in a rolling test using a tester. As a result, an increase in the rolling load was confirmed in a low speed region during the latter half of the pass during which the deformation resistance value during rolling becomes high.

One of the causes for the rolling load increasing in the latter half of the pass is considered to be that strain rate dependence decreased in the region where deformation resistance rose, and changes in the coefficient of friction due to decreases in the rolling speed appeared directly as changes in the rolling load. To curb the amount of the increase in the rolling load, tensions on the entry side and the exit side of the rolling mill were increased. As expected, it was confirmed that the rolling load could be reduced. In addition, the strip tension between the first rolling mill 10*a* and the second rolling mill 10*b* may be increased to curb the amount of increase in the rolling load.

Thus, tension generating devices 60, 70 are installed on the entry side and exit side of the rolling mill to impart front tension and back tension in the low speed region of the latter-half pass where deformation resistance increases, thereby curtailing the increase in the rolling load. The tension generating devices 60, 70 for generating tension in the strip S are disposed at a stage anterior to the first rolling mill 10*a* and a stage posterior to the second rolling mill 10*b*. Pinch rolls or bridle rolls, for example, are named as the tension generating devices 60, 70, and they have drive devices and control devices.

Further, the tension generating device 60 on the entry side of the first rolling mill 10*a* outputs desired tension, and also shows the effect of preventing the instability of the strip thickness and the shape because of the back tension of the first rolling mill 10*a* becoming zero during joining. Also, the tension generating device 70 on the exit side of the second rolling mill 10*b* outputs desired tension, and also shows the effect of preventing the instability of the strip thickness and the shape because of the front tension of the second rolling mill 10*b* becoming zero during cutting of the preceding coil and the succeeding coil.

The tension generating device 70 imparts front tension necessary for rolling by the second rolling mill 10*b*. The tension generating by the coil winding device 24 is limited to tension necessary for winding of the coil. Thus, the coil wrapping and squeezing force can be minimized, and flaws due to slippage between the layers of the coil and buckling of the internal diameter portion of the coil can be prevented.

In rolling during joining, the rolling speed during joining of the strip tail end of the preceding coil 22*a* (25*b*) and the strip leading end of the succeeding coil 22*b* is rendered a low speed of 50 mpm or less, preferably 20 mpm or less, more preferably 10 mpm or less, still more preferably 5 mpm or less, further preferably 2 mpm or less, by the rolling speed control device 40, whereby the length of the strip stored in the strip storage device 50 is shortened. Also, tension control by the tension generating devices 60, 70 curtails the amount of the increase in the rolling load.

The strip storage device 50 disposed between the joining device 23 and the first rolling mill 10*a* stores the strip S with a length of 100 m or less, preferably 50 m or less, more preferably 20 m or less, still more preferably 10 m or less, further preferably 5 m or less, in the above-mentioned low speed region. By so doing, while the strip S is being joined by the joining device 23, the strip S of the above-mentioned length stored beforehand in the strip storage device 50 is paid out, whereby the strip S can be continuously rolled. By so constructing the strip storage device 50 accommodating the shortened strip, moreover, the length of the entire equipment can be shortened, and the cost of constructing the equipment can be reduced.

Generally, under low speed rolling conditions, according to the gage control method in which the strip thickness is measured by a gage meter installed on the exit side of the rolling mill, and is modified based on the deviation between the strip thickness command value and the actual strip thickness value, the accuracy of gage control declines due to a time lag from rolling directly below the work rolls of the rolling mill until detection of the strip thickness. Under the low speed rolling conditions, therefore, the tension before the first rolling mill 10*a* and the tension after the second rolling mill 10*b* are incorporated into gage control. The entry-side rolling speed, the entry-side strip thickness, and the exit-side rolling speed are measured. Based on these measured values, the strip thickness directly below the work rolls of the rolling mill is computed, and gage control is exercised such that the desired strip thickness is achieved by the hydraulic roll gap control devices 91*a*, 91*b* possessed by the rolling mills 10*a*, 10*b*. By so doing, the strip thickness ratio accurate to about 1% or less, which is the same strip thickness accuracy as in the ordinary rolling speed region, can be achieved.

Moreover, the entry-side strip thickness may be measured, and gage control may be exercised by feed forward control.

Examples of the first rolling mill 10*a* and the second rolling mill 10*b* are a 4-high mill, a 6-high mill (6H mill), a pair cross mill, an 18 HZ-high mill, a 20-high Sendzimir mill, a cluster mill, and a 12-high Rohn mill. A preferred example is a 6-high mill. The application of the 6-high mills as the first rolling mill 10*a* and the second rolling mill 10*b* makes it possible to reduce the amount of a change in roll deflection due to a change in the rolling load associated with an increase in the coefficient of friction during low speed rolling, thus controlling the shape of the strip stably. As a result, a shortage of the plate or the excessive reduction of the area can be curtailed, and rolling can be performed stably. The use of the two rolling mills, i.e., first rolling mill 10*a* and second rolling mill 10*b*, is suitable for medium-scale production with an annual production volume of the order of 600,000 tons to 900,000 tons.

Next, the effects of the application of 6-high mills, especially an HC mill and a UC mill which are 6-high mills with an intermediate roll shift function, will be described based on FIGS. 5 to 8.

As stated earlier, the maximum effect obtained by applying the 6-high mill as the rolling mill is the high ability to correct the amount of change in the roll deflection due to the change in the rolling load during low speed rolling dynamically by a roll bender or the like, thereby permitting the strip shape to be controlled stably. The 6-high mill is also characterized by a smaller amount of change in the deflection deformation of the work roll due to a load change than in a 4-high mill.

To demonstrate the effect of application of a 6-high mill on the shape control of a strip, shape simulation was performed as compared with a 4-high mill. A rolled material with a plate width of 1200 mm was cold rolled in two passes from a 2.0 mm base material into a product strip thickness of 0.4 mm. The rolling speed was in a range of 450 mpm to 1200 mpm in a steady state, or in a range of 2 mpm or less at a low speed. The minimum output value and the maximum output value of the roll bender of each rolling mill were used. The rolling mill has a higher ability to correct a disturbance in the shape, and has a better shape control ability, as the range of its shape control capacity becomes wider. The results of the simulation are shown in FIGS. 5 to 8.

Figure 5:
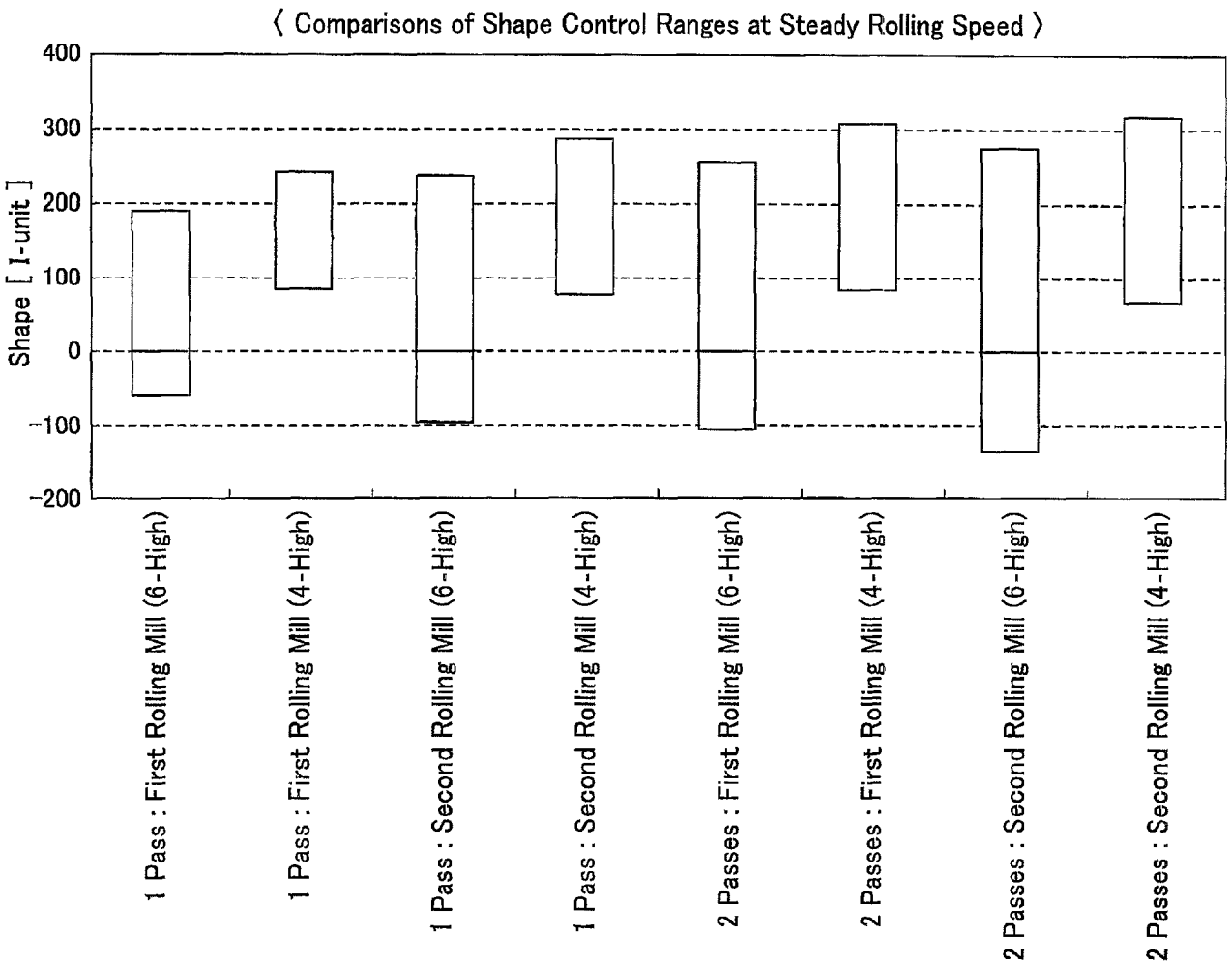
FIG. 5 is a graph showing comparisons between the shape control ranges of six-high rolling mills and four-high rolling mills at a steady rolling speed.
Figure 6:
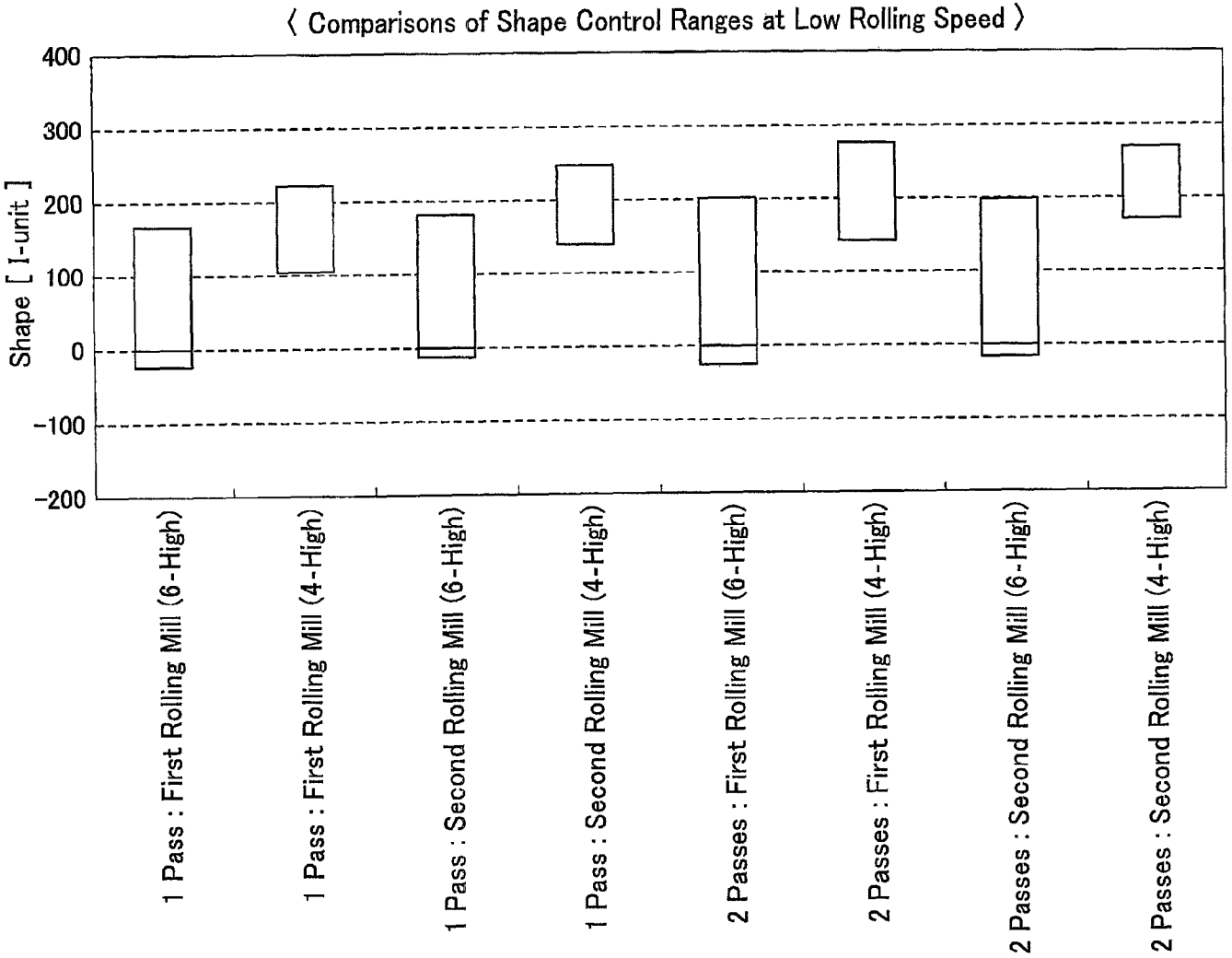
FIG. 6 is a graph showing comparisons between the shape control ranges of six-high rolling mills and four-high rolling mills at a low rolling speed.
Figure 7:
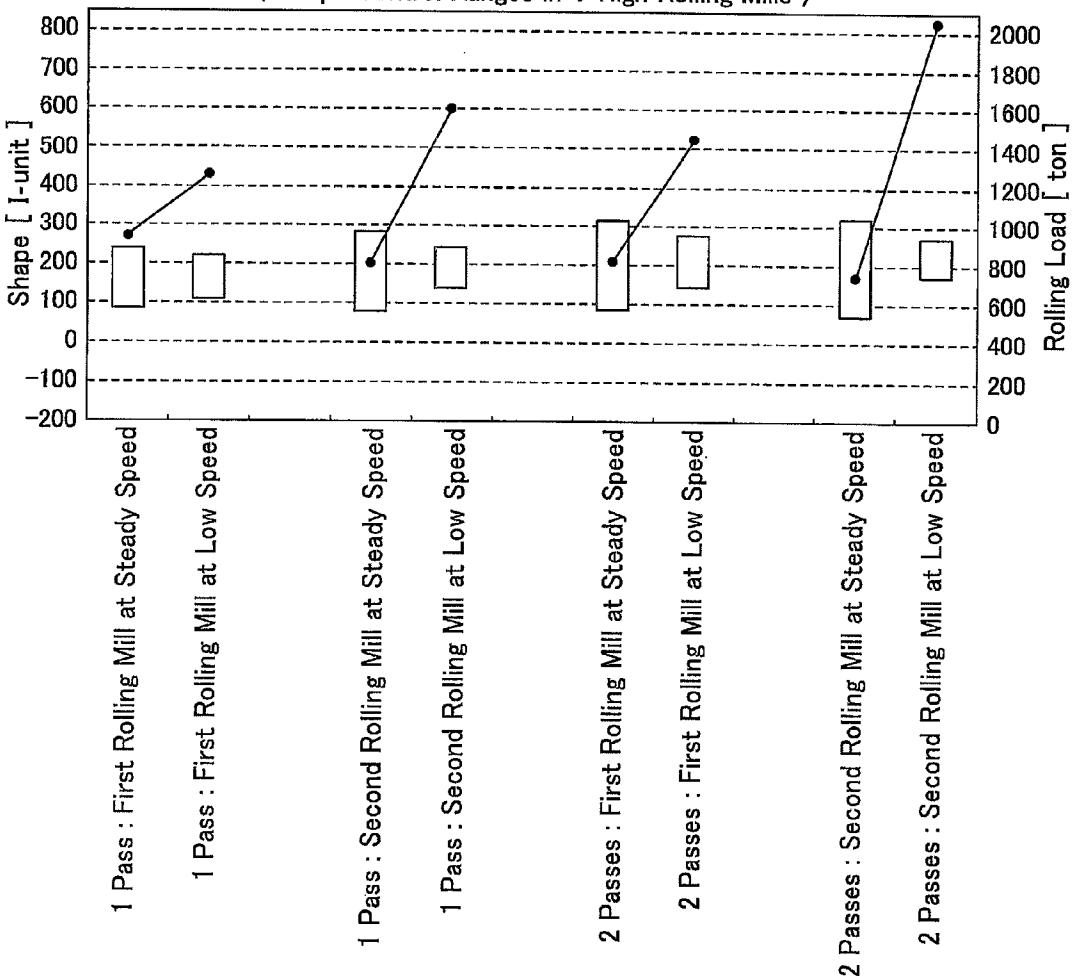
FIG. 7 is a graph showing comparisons of the rolling loads and the shape control ranges of four-high rolling mills at a steady rolling speed and a low rolling speed.
Figure 8:
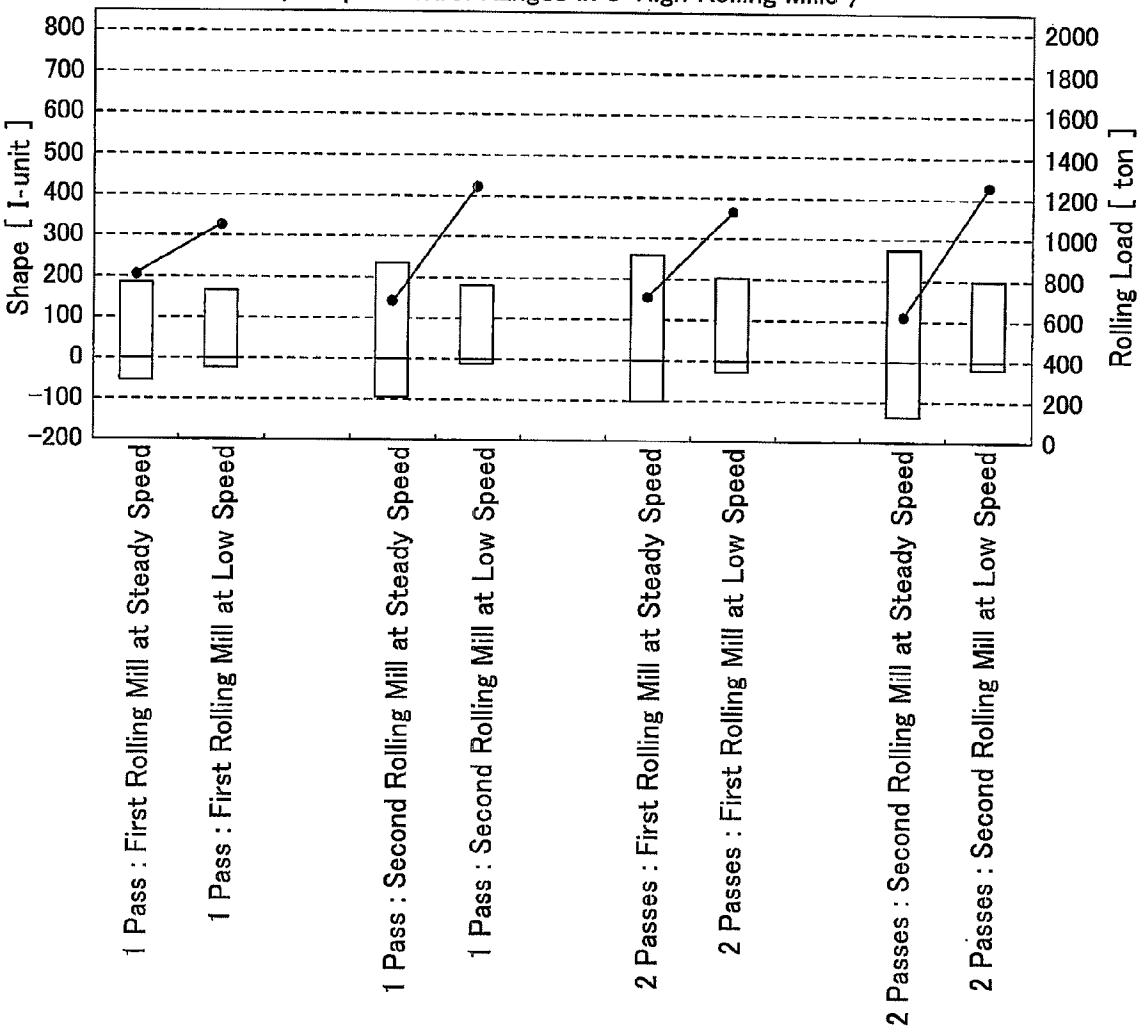
FIG. 8 is a graph showing comparisons of the rolling loads and the shape control ranges of six-high rolling mills at a steady rolling speed and a low rolling speed.

FIG. 5 is a graph showing comparisons between the shape control ranges of 6-high mills and 4-high mills at a steady rolling speed. FIG. 6 is a graph showing comparisons between the shape control ranges of 6-high mills and 4-high mills at a low rolling speed. FIG. 7 is a graph showing comparisons of the rolling loads and the shape control ranges of 4-high mills at a steady rolling speed and a low rolling speed. FIG. 8 is a graph showing comparisons of the rolling loads and the shape control ranges of 6-high mills at a steady rolling speed and a low rolling speed. In these drawings, the abscissa represents the number of rolling passes and the rolling mills, and the ordinate represents the shape (I-unit). In FIGS. 7 and 8, the ordinate on the right side represents the rolling load.

As shown in FIG. 5, when the rolling speed was steady, it became clear that the shape control range of the 6-high mill was by far wider than that of the 4-high mill.

As shown in FIG. 6, under the conditions where the rolling speed was low and the rolling load increased, it was clear that the shape control range of the 6-high mill was by far wider than that of the 4-high mill, although its range was narrow compared with the shape control range at the steady rolling speed.

As shown in FIG. 7, if a comparison was made between the steady rolling speed and the low rolling speed in the 4-high mill, the shape control range at the low speed was so narrow because of an increased rolling load that correction of the shape was insufficient, thus resulting in a high possibility for the inability to suppress the occurrence of an accident such as the necking of the strip.

As shown in FIG. 8, on the other hand, if a comparison was made between the steady rolling speed and the low rolling speed in the 6-high mill, the shape control range at the low speed was narrower than at the steady speed, similar to the 4-high mill. However, the 6-high mill had a necessary and sufficient shape control ability, and an adequate shape control ability in response to changes in the rolling load. These facts were demonstrated by the present simulations.

Thus, the 6-high mill was demonstrated to be a suitable rolling mill for the present invention.

In a verification test using a tester, shape control using roll bender control and roll coolant control was applied based on the results of computation of roll deflection due to changes in the rolling load. According to a method in which the amount of deviation from the desired shape during ordinary rolling was confirmed by a shape meter, and then a correction was made, a time lag occurred to cause shape disturbance inevitably. By contrast, the above control was confirmed to be successful in modifying the shape without a time lag and obtain a satisfactory shape with 10 I-units or less.

Since the two coil unwinding devices 21*a*, 21*b* are adopted, when the strip S is joined by the joining device 23, a waiting time until arrival of the leading end of the succeeding coil 22*a* or 22*b* is eliminated, so that a decrease in the annual production volume can be prevented.

Figure 9:
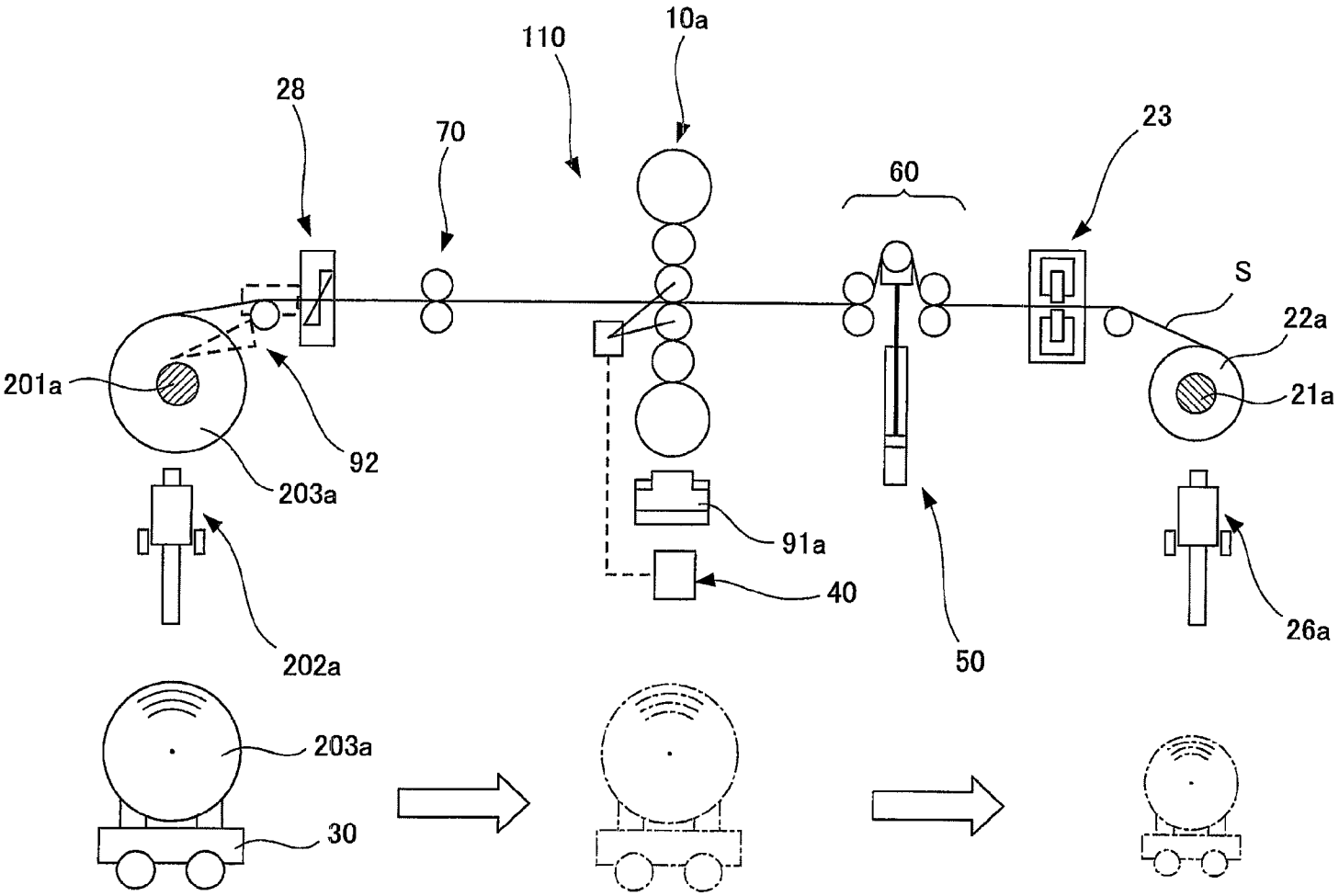
FIG. 9 is a schematic view of cold rolled material manufacturing equipment according to another embodiment of the present invention.
Figure 11:
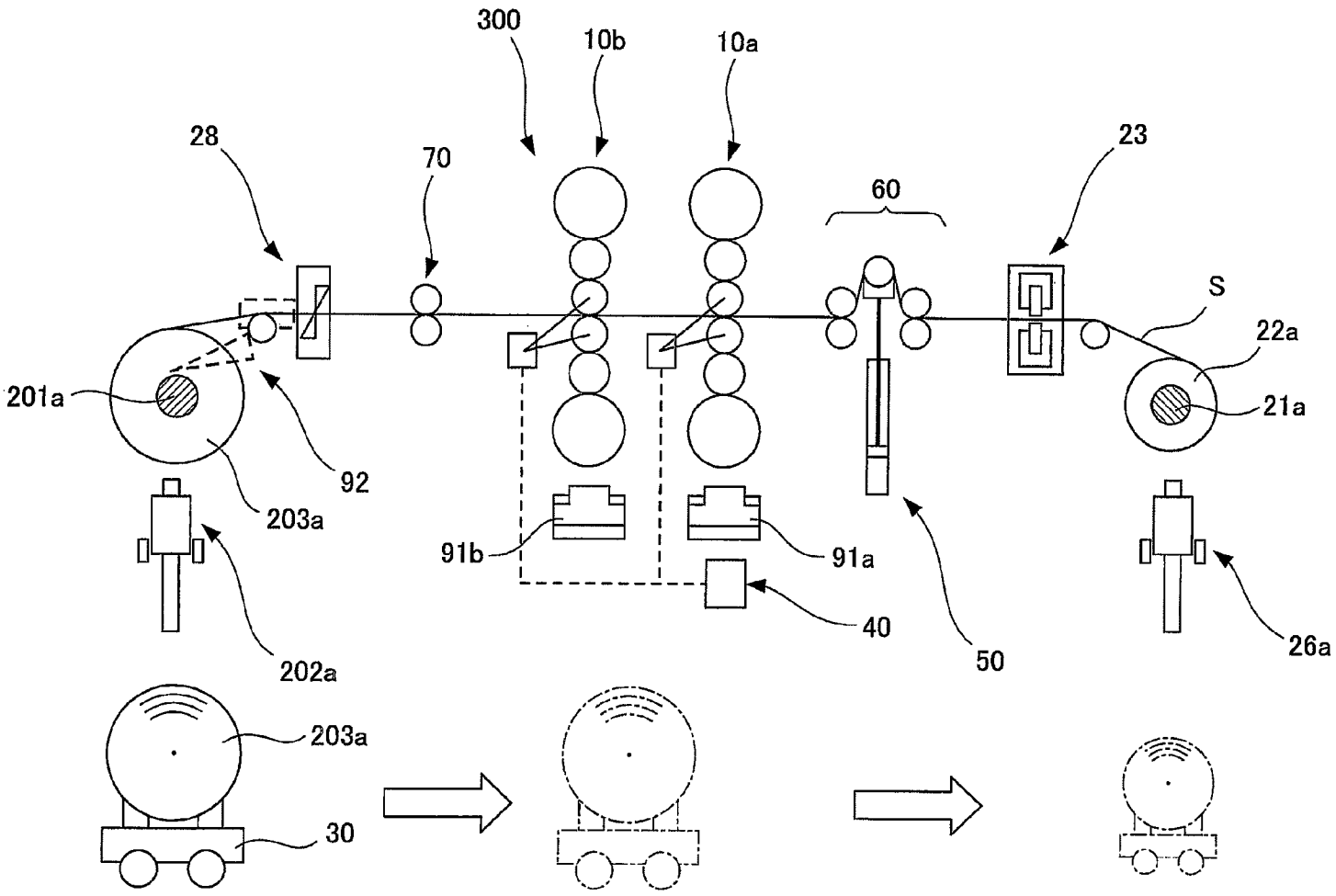
FIG. 11 is a schematic view of cold rolled material manufacturing equipment according to another embodiment of the present invention.
Figure 15:
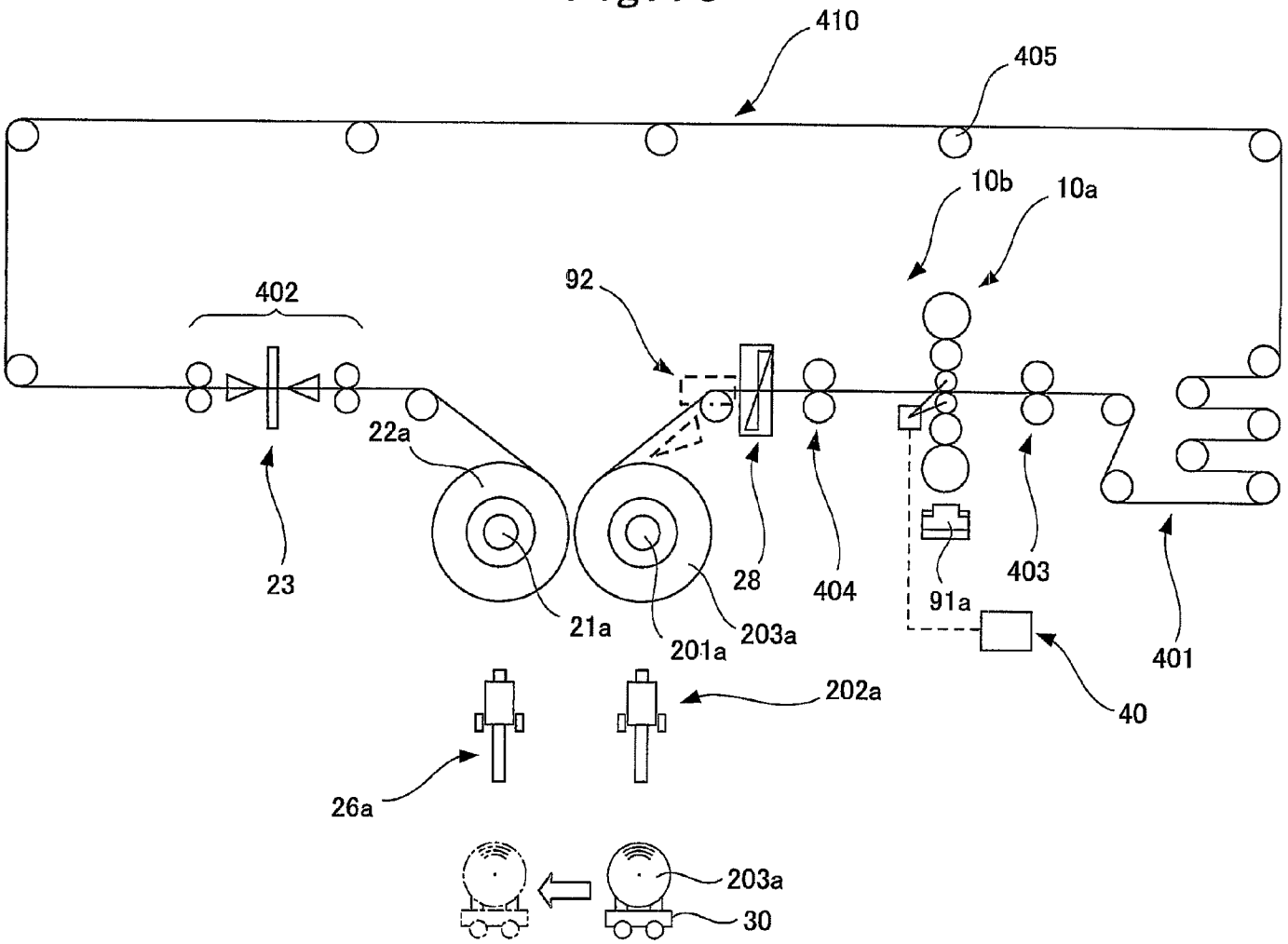
FIG. 15 is a schematic view of cold rolled material manufacturing equipment according to another embodiment of the present invention.

If a desired production volume is obtained, however, the number of the coil unwinding devices may be one, as shown in FIGS. 9, 11 and 15 to be described later.

As the joining device 23, various joining devices are named, such as FBW, LBW, an MAG welder, a friction stir joining machine, and MSW. MSW is a preferred example.

In this cold rolled material manufacturing equipment 100, the coil is transported from the coil winding device 24 to the coil unwinding devices 21*a*, 21*b*, and cold rolled a plurality of times, until the desired product strip thickness is attained, as stated earlier. Thus, the strip thickness range of the strip S subjected to joining by the joining device 23 becomes 0.1 mm to 6.0 mm, which is a wider strip thickness range for joining than before. Furthermore, the minimum strip thickness for joining is 1.0 mm or less, meaning joining in the range of a thinner sheet than in the conventional PL-TCM and TCM.

When FBW is used, joining of plates with a thickness of 1.6 mm or less is difficult because of a problem such as buckling. When LBW is used, butts in a broad strip thickness range of 0.1 mm to 6 mm cannot be joined together by a single joining device. A plurality of expensive joining devices are required in conformity with the strip thickness range, thus incurring immense expenses for the introduction of equipment. Moreover, a very high accuracy is required at the site of cutting of the leading end and tail end of the coils to be butt joined. Outside the range of this accuracy, the plate breakage rate of the material to be rolled noticeably increases.

According to the results in the PL-TCM equipment, if there is a difference in the strip thickness between the tail end of the preceding coil and the leading end of the succeeding coil, a step is formed at the site of joining, even with the use of FBW and LBW. Thus, an impact force acts at the time of rolling, thereby dramatically increasing the probability of breakage at the junction. Hence, the strip thickness difference is limited to within 1 mm, and the strip thickness ratio is limited to within 1:1.5, in carrying out rolling. Even this method has not been successful in solving the problem that the junction of the strip breaks during rolling with a frequency of once every 1000 times. If a further decrease in the probability of breakage is intended under the joining conditions involving the limited strip thickness, the amount of rolling reduction at the junction and in the vicinity of the junction is rendered smaller than the amount of rolling reduction at the steady rolling portion by on-the-fly gage changing. By so doing, the probability of breakage at the junction is further decreased.

Besides, the rolling speed at the junction and in the vicinity of the junction is rendered more than 0 mpm, but not more than 50 mpm, preferably more than 0 mpm, but not more than 10 mpm, more preferably more than 0 mpm, but not more than 5 mpm, and still more preferably more than 0 mpm, but not more than 2 mpm, by the rolling speed control device 40. In addition, the above-mentioned gage control and shape control in the low speed region are applied, whereby the timings for the initiation and termination of on-the-fly gage changing can be brought as close as possible to the point of joining. Thus, the range of the on-the-fly gage changing presenting off-gage is minimized.

The junction, at which the strip thickness ratio between the tail end of the preceding coil and the leading end of the succeeding coil to be joined exceeds 1:1.5, or the strip thickness difference between them exceeds 1 mm, has so far been impossible to roll. The amount of rolling reduction at this junction and in the vicinity of the junction is rendered smaller than the amount of rolling reduction at the steady rolling portion by on-the-fly gage changing. In addition, the rolling speed at the junction and in the vicinity of the junction is set to exceed 0 mpm, but be not higher than 50 mpm, preferably exceed 0 mpm, but be not higher than 10 mpm, more preferably exceed 0 mpm, but be not higher than 5 mpm, still more preferably exceed 0 mpm, but be not higher than 2 mpm, by means of the rolling speed control device 40. By this measure, the impact force during rolling at the junction is diminished, and the desired joining strength is maintained. Besides, the restrictions on the thicknesses of the plates to be joined are relaxed, and the restrictions on coil operation, such as the sequence of the coils subjected to rolling, are markedly lightened.

With MSW, on the other hand, the diffusion joining portion having lower joining strength than that of the base material remains at both ends of the weld line. If the total rolling reduction rate of rolling exceeds 50% of the strip thickness of the base material, breakage is apt to take place, with the diffusion joining portion as the starting point. Thus, MSW has scarcely been applied to cold rolling, particularly in TCM equipment including PL-TCM equipment, because the probability of breakage becomes very high at the rear stage of the rolling mill where the total rolling reduction rate of rolling exceeds 50% of the strip thickness of the base material.

In applying MSW or in rolling the junction with minimal rolling resistance performance, the total rolling reduction rate of rolling at the junction is set at 50% of the strip thickness of the base material in the case of MSW. For other type of joining, in a region where the rolling reduction rate corresponding to the rolling resistance strength is exceeded, the amount of rolling reduction at the junction and in the vicinity of the junction is rendered smaller than the amount of rolling reduction at the steady rolling portion by on-the-fly gage changing. By so doing, the probability of breakage at the junction is further decreased.

Moreover, the rolling speed at the junction and in the vicinity of the junction is rendered more than 0 mpm, but not more than 50 mpm, preferably more than 0 mpm, but not more than 10 mpm, more preferably more than 0 mpm, but not more than 5 mpm, and still more preferably more than 0 mpm, but not more than 2 mpm, by the rolling speed control device 40. In addition, the above-mentioned gage control and shape control in the low speed region are applied, whereby the timings for the initiation and termination of on-the-fly gage changing can be brought as close as possible to the point of joining. Thus, the range of the on-the-fly gage changing resulting in off-gage is minimized.

MSW is capable of joining plates with thicknesses of 4.5 mm or less. In joining plates with thicknesses of 4.5 mm or more, therefore, the use of an MAG welding machine is recommendable. By using such a joining machine and adopting the above-mentioned joining method, joining with excellent rolling resistance performance can be performed for strip thicknesses of 0.1 mm to 6.0 mm. There are few restrictions on the type of steel which can be joined, and the cost of introducing the equipment and the cost of maintenance of the equipment are lower than other joining devices. Thus, MSW and the MAG welding machine are the most preferred joining devices for use in the aforementioned cold rolled material manufacturing equipment 100.

When the material to be rolled is a non-ferrous metal such as an aluminum alloy, a copper alloy, or a magnesium alloy, a friction stir joining device which is inexpensive and has high strength reliability of the junction provides the most suitable joining.

The strip cutting device 28 for cutting the strip S is disposed between the tension generating device 70 on the exit side of the second rolling mill 10*b* and the coil winding device 24. As the strip cutting device 28, a guillotine shear, a drum shear, a flying shear, or a rotary shear, for example, is named. The strip S is cut by this strip cutting device 28, whereby a coil of a desired size can be formed.

A carrousel reel is used as the coil winding device 24, whereby coils can be continuously wound onto 24*a* and 24*b*, without setting the rolling speed at a low speed of 150 mpm or lower, to prevent a decrease in the annual production volume.

If the desired production volume is obtained, however, the coil winding device may be one tension reel, as shown in FIGS. 9, 11, 14 and 15 to be described later.

As the coil transport device 30, there is named a hoisting attachment or a bogie loaded with a pallet which can carry the coils 25*a*, 25*b*.

A cold rolling method in the cold rolled material manufacturing equipment 100 of the above-described configuration will be described below.

The present rolling method described below is assumed to carry out rolling in two passes, until the desired product strip thickness is obtained, by the two rolling mills 10*a* and 10*b* with the features of FIG. 1 in medium-scale manufacturing equipment with an annual production volume of the order of 600,000 tons to 900,000 tons.

Initially, the succeeding coil 22*a* or 22*b* loaded on the entry-side coil car 26*a* or 26*b* is transported to and inserted into the coil unwinding device 21*a* or 21*b*, and unwinding of the strip S from the coil unwinding device 21*a* or 21*b* is started.

Here, the preceding coil is taken as 22*a*, and the succeeding coil as 22*b*, for explanation. The preceding coil 22*a* turns into 25*b* when it arrives at the coil winding device 24*a*. A portion with a length of the order of several meters in the vicinity of the tail end of the strip S of the preceding coil 22*a* (25*b*) is stored in the strip storage device 50 before the tail end of the strip of the preceding coil 22*a* (25*b*) arrives at the joining device 23, in order that rolling is not stopped for a time during which the tail end of the strip of the preceding coil 22*a* (25*b*) is kept stopped at the joining device 23 (the time represents a joining preparation time, a joining time, and a post-joining treatment time; hereinafter, all these times are combined, and collectively described as the joining time).

The length of the strip stored can be determined by the joining time and the entry-side rolling speed of the first rolling mill 10*a*. For example, the details of the joining time are as follows: Since the coil unwinding devices are two, 21*a* and 21*b*, the coil is unwound by one of the coil unwinding devices, while the other coil unwinding device can make preparations for unwinding the coil without obstructing treatment by the one coil unwinding device. The joining preparation time is about 0.5 minute, the joining time for joining of the tail end of the preceding coil 22*a* (25*b*) and the leading end of the succeeding coil 22*b* is about 1.0 minute, and the post-treatment time after joining is about 0.5 minute. In total, the joining time is about 2.0 minutes. If the entry-side rolling speed of the first rolling mill 10*a* during joining is assumed to be 1.0 mpm (m/min), for example, the length of the strip in storage is 2.0 m. During joining, the stored strip S is paid out of the strip storage device 50.

In the first pass, coil build-up for making several coils into one coil is carried out to decrease the number of times that the tail end of the strip of the preceding coil 22*a* (25*b*) and the leading end of the strip of the succeeding coil 22*b* are joined, and the number of times that the resulting built-up coil is cut, in the second and later passes, and utilizing the joining time and the cutting time corresponding to the decreases in the number of times as the rolling time, thereby increasing the annual production volume.

Preferably, it is desired to build 3 coils or so up into a coil so that the coil winding and unwinding devices do not go beyond the conventional specifications. For example, 3 coils are joined to form a built-up coil, thereby decreasing the number of times that joining and cutting are performed by two times each. As a result, the joining time and the cutting time can be shortened in correspondence with the decreases in the number of times. Furthermore, the number of the coils circulated can be cut down, whereby a high efficiency operation can be performed.

The coil, which is a build-up of several coils having completed joining in the first pass, has the junction rolled similarly to rolling of the steady portion, if the strength of the junction has leeway. If there is no leeway in the strength of the junction, or if the strip thickness ratio at the junction of the joined plates exceeds 1:1.5, or if the strip thickness difference between these coils exceeds 1 mm, rolling of the junction is performed at the aforementioned FGC to maintain the joining strength, and rolling is completed. Then, the coil is cut off a next coil by the strip cutting device 28, and wound onto the coil winding device 24. By configuring the coil winding device 24 to be a carrousel reel, as mentioned above, it is necessary to reduce the exit-side rolling speed at the time of cutting only to a value of the order of 150 mpm, and the number of times joining is carried out is cut down. Thus, the production volume is increased.

The built-up coil after the first pass, wound by the coil winding device 24, is withdrawn from the coil winding device 24 by the exit-side coil car 27, and transported to the entry-side coil car 26*a* or 26*b* by the coil transport device 30. During this transport work, the coil winding device 24 starts winding of the next coil. The transported built-up coil is inserted again into the coil unwinding device 21*a* or 21*b* by the entry-side coil car 26*a* or 26*b*, and begins to be uncoiled for the second pass. The leading end of the strip of the built-up coil unwound from the coil unwinding device 21*a* or 21*b* arrives at the joining device 23, where it is joined to the preceding coil. Joining at this time is joining of plates with different thicknesses, i.e., the base material with a large thickness before start of the first pass and the sheet with a small thickness before start of the second pass, or is joining of sheets with the same thickness or different thicknesses before start of the second pass.

The coil after rolling, which has the desired strip thickness after completion of the second pass, is divided into a desired coil length by the strip cutting device 28, and wound as a divisional coil onto the coil winding device 24. The divisional coil is withdrawn by the exit-side coil car 27, and transported as a product coil to a next step.

By repeating such a series of rolling methods, the product coil is manufactured.

In cold rolling, there is a case where the roll is uniformly roughened, whereby the surface of the strip is finished to a satin-like unglossy state called a dull appearance (generally called a dull finish), so that a coated surface is uniformized in a next coating step.

In the above-mentioned cold rolled material manufacturing equipment 100, every time the rolling pass is completed, the coil can be withdrawn. Thus, if dull-finish rolling is necessary, for example, a group rolling mode is possible in which rolling operations until dull finishing are all completed, and the resulting coils are stored, whereafter the rolls are replaced by rolls having a rough roll surface, and the manufactured coils kept in storage are dull finished at a stroke. Consequently, a decline in the manufacturing efficiency can be suppressed.

Next, the evaluation of the annual production volume in each cold rolled material manufacturing equipment will be described based on FIGS. 3*a*, 3*b*, 3*c* and 3*d*.

The rolling conditions on this occasion were such that materials to be rolled, corresponding to three coils, were each cold rolled from a 2.0 mm base material into a product strip thickness of 0.4 mm, and the maximum value of the steady rolling speed was set at 1200 mpm. Concretely, comparisons were made using time-charts in each rolling equipment. FIG. 3*a* represents a time-chart in the aforementioned cold rolled material manufacturing equipment 100. FIG. 3*b* shows a time-chart in TCM equipment having 4 rolling mills. FIG. 3*c* shows a time-chart in RCM equipment having one rolling mill. FIG. 3*d* shows a time-chart with 2-stand reverse equipment. In these drawings, the abscissa represents the elapsed time (sec), and the ordinate represents the rolling speed (mpm).

In the cold rolled material manufacturing equipment 100, as shown in FIG. 3*a*, rolling was completed in 2 passes. The rolling speed in the first pass of rolling was set at about 600 mpm and, when the coil was joined, this speed was adjusted to about 2 mpm. In the second pass, rolling was possible at a rolling speed of about 1200 mpm. It was found that 3 coils could be rolled in 35.9 minutes to manufacture a steel plate. In the TCM equipment having 4 rolling mills, as shown in FIG. 3*b*, when the rolling speed was set at 1200 mpm, three coils could be rolled in 17.2 minutes to manufacture a steel plate. In the RCM equipment with one rolling mill, as shown in FIG. 3*c*, rolling was conducted in 4 passes, with the rolling speed being gradually increased every time one pass was performed, and reaching 1200 mpm in the final pass. It was found that 3 coils could be rolled in 85.7 minutes to manufacture a steel plate. In the 2-stand reverse equipment, as shown in FIG. 3*d*, rolling was successful at a rolling speed of about 600 mpm in the first pass, and at a rolling speed of 1200 mpm in the second pass, and it was found that 3 coils could be rolled in 47.1 minutes to manufacture a steel plate.

In the light of the above results, the production volume of steel plates per year, on the assumption that production was performed for 7000 hours yearly, was about 800,000 tons in the cold rolled material manufacturing equipment 100, about 1,200,000 tons in the TCM equipment having four rolling mills, about 300,000 tons in the RCM equipment having one rolling mill, and about 600,000 tons in the 2-stand reverse equipment. Thus, it was verified that the cold rolled material manufacturing equipment 100 had a production volume 33% more than that of the 2-stand reverse equipment, possessing high productivity.

Next, the evaluation of the off-gage rate in each cold rolled material manufacturing equipment will be explained based on FIG. 4.

The off-gage rate was about 6.0% in the 2-stand reverse equipment, about 2.5% in the RCM equipment having one rolling mill, and about 0.2% in the TCM equipment. The off-gage rate in the cold rolled material manufacturing equipment 100 was about 0.3% at a maximum, showing that the yield was dramatically increased compared with the RCM equipment, and the obtained result was closer to that of the existing TCM equipment.

Based on the above results, therefore, according to the cold rolled material manufacturing equipment 100, a production volume of the order of about 800,000 tons/year can be achieved by an inexpensive equipment configuration involving two rolling mills, and the product yield can be kept to the conventional TCM level. Moreover, the tiresome passage work and the unrolled portion in the first pass and the second pass, which are disadvantages of the RCM equipment, can be eliminated, and the off-gage rate of the order of about 2.5% to 6.0% can be rendered about 1.0% or less, a level close to the levels of the TCM equipment and the PL-TCM equipment.

Furthermore, continuous operation can markedly increase the production volume. Also, the personnel necessary for the plate passage operation can be cut down. Besides, the restrictions on the number of times rolling is performed are eliminated. Nor is the unrolled portion present. Accordingly, plates of various strip thicknesses and steel types can be rolled, producing the advantage that the range of the product strip thickness can be expanded in comparison with the existing rolling equipment.

If an annual production volume of the order of 300,000 to 400,000 tons is assumed, one rolling mill 10*a* is arranged in the cold rolled material manufacturing equipment 100.

As shown in FIG. 9, a single coil unwinding device 21*a* is used, and the rolling speed is controlled by a rolling speed control device 40 to a low speed of 50 mpm or lower, preferably 20 mpm or lower, more preferably 10 mpm or lower, still more preferably 5 mpm or lower, and further preferably 2 mpm or lower, from a time when the tail end of a preceding coil departs from the coil unwinding device 21*a* until a succeeding coil inserted into the coil unwinding device 21*a* is unwound at a higher speed than the above rolling speed, and joining of the preceding coil and the succeeding coil by a joining device 23 is completed, with the strip stored beforehand in a strip storage device 50 being paid out. By so doing, the one unwinding device enables continuous rolling to be performed, and makes it possible to cut down on the number of instrument operators, decrease the locations of maintenance, and reduce the cost of equipment.

Furthermore, a single coil winding device 201*a* is used and, after or simultaneously with cutting of the strip by a strip cutting device 28, the rolling speed is controlled by the rolling speed control device 40 to a low speed of 50 mpm or lower, preferably 20 mpm or lower, more preferably 10 mpm or lower, still more preferably 5 mpm or lower, and further preferably 2 mpm or lower, while a coil 203*a* is withdrawn from the winding device 201*a*, and the leading end of a succeeding coil is guided to the winding device 201*a* by a guide device 92 disposed between the strip cutting device 28 and the coil winding device 201*a*, and is wound by the winding device 201*a*, with rolling being performed continuously. By so doing, the number of instrument operators can be cut down, the locations of maintenance can be decreased, and the cost of equipment can be reduced.

The strip S is joined by the joining device 23 and the joining method described above, and the coils are built up as in the aforementioned cold rolled material manufacturing equipment 100. By so doing, the number of times joining is performed, the number of times cutting is performed, and the number of coils circulated are decreased.

Thus, an operation with high efficiency and high yield can be achieved by inexpensive and compact equipment.

Figure 10:
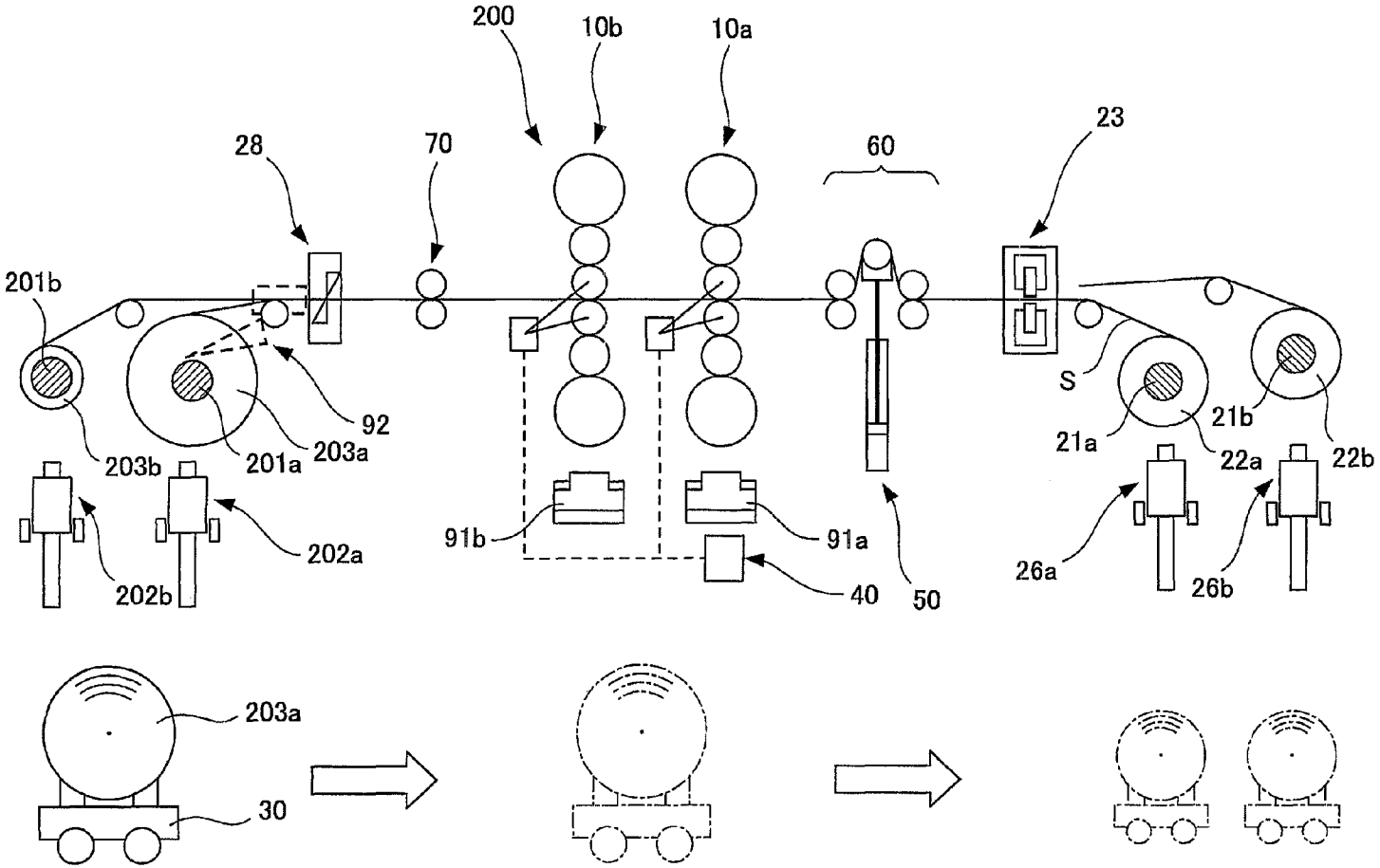
FIG. 10 is a schematic view of cold rolled material manufacturing equipment according to another embodiment of the present invention.

Using a configuration with two rolling mills 10*a* and 10*b*, there can be constructed cold rolled material manufacturing equipment 200 having two tension reels (coil winding devices) 201*a*, 201*b* and two exit-side coil cars 202*a*, 202*b* as shown in FIG. 10, or cold rolled material manufacturing equipment 300 having one coil unwinding device 21*a*, one entry-side coil car 26*a*, one coil winding device 201*a* and one exit-side coil car 202*a* as shown in FIG. 11, in accordance with the production volume.

Figure 12:
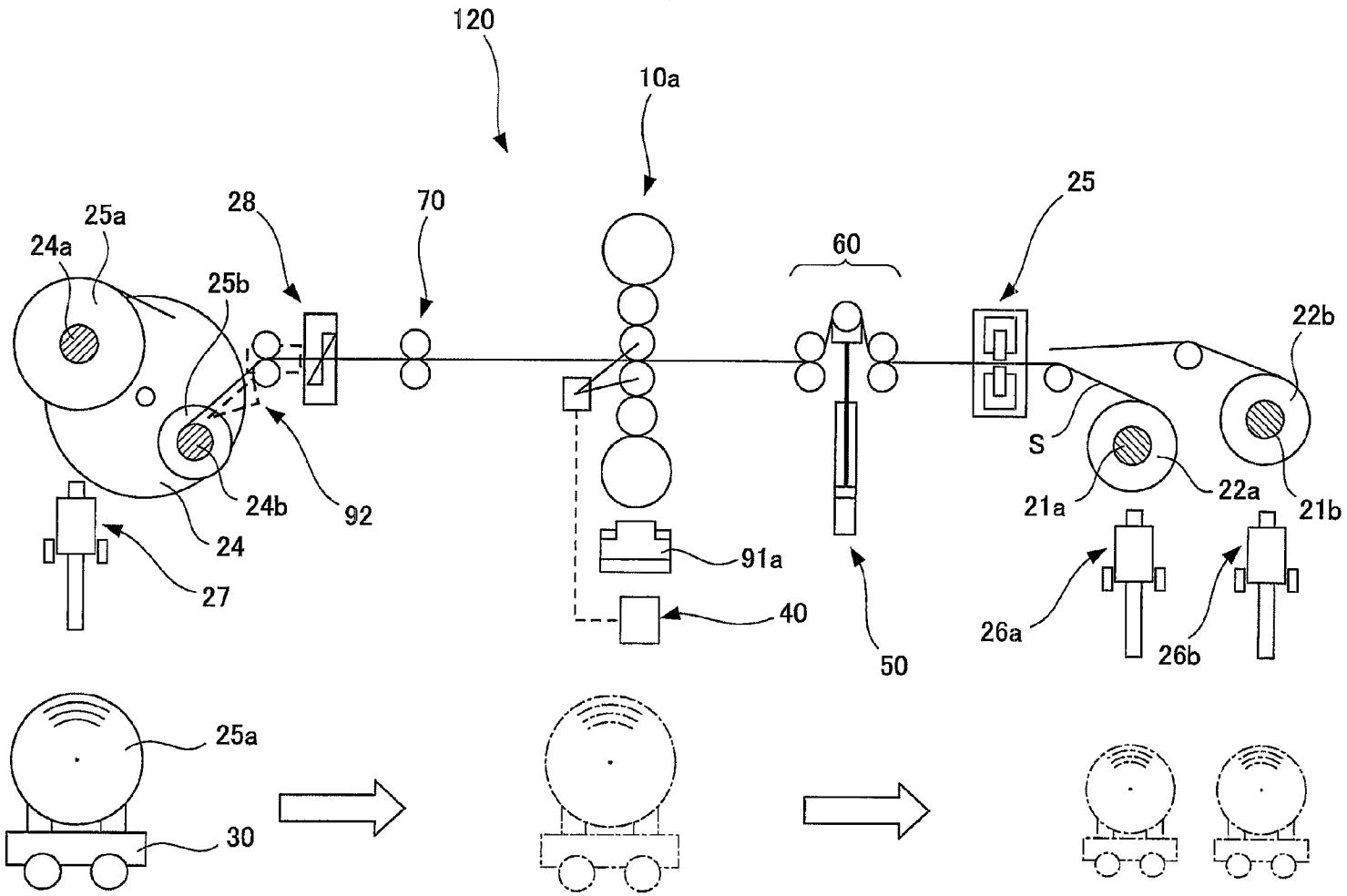
FIG. 12 is a schematic view of cold rolled material manufacturing equipment according to another embodiment of the present invention.
Figure 13:
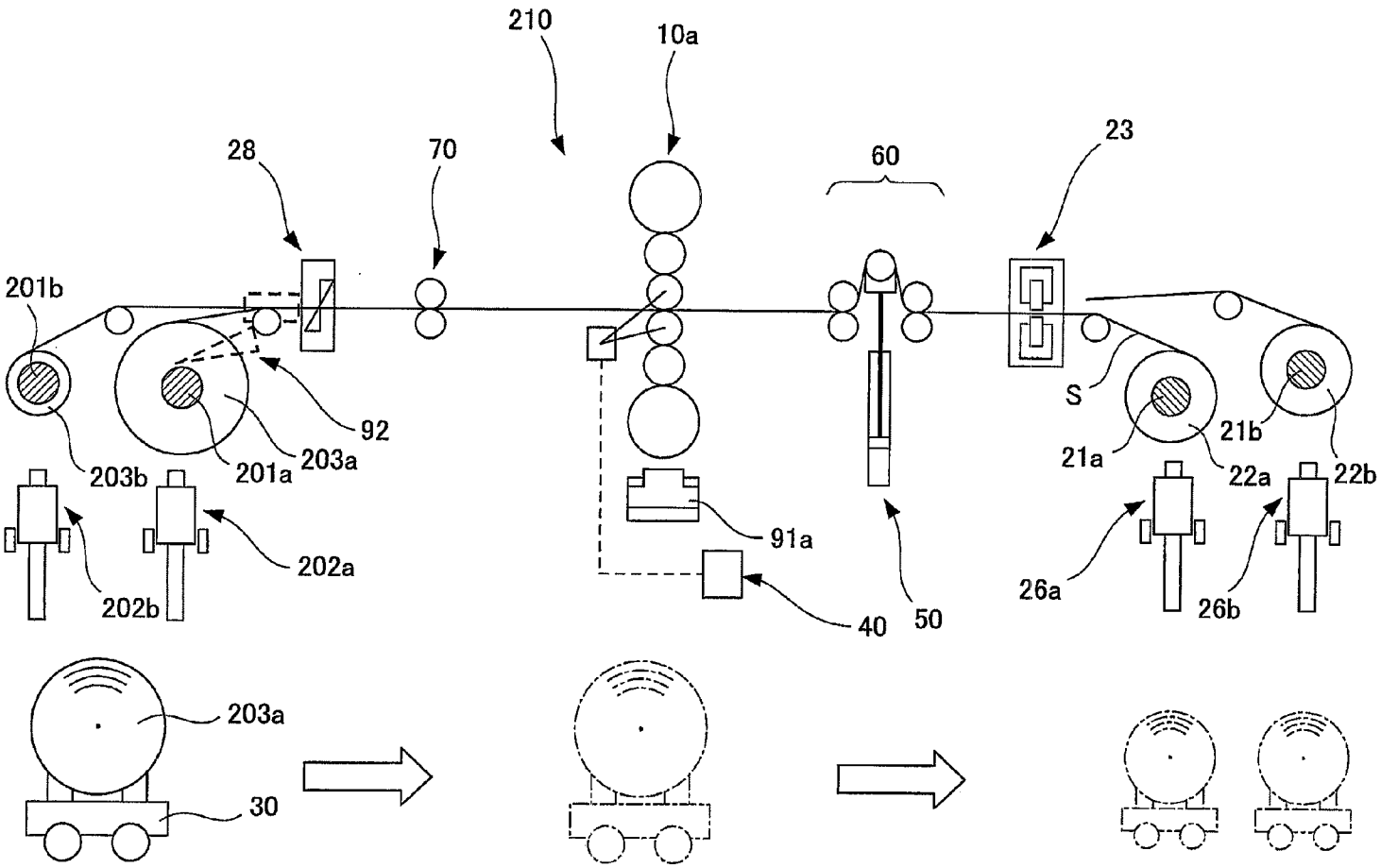
FIG. 13 is a schematic view of cold rolled material manufacturing equipment according to another embodiment of the present invention.

Using a configuration with one rolling mill 10*a*, there can be constructed cold rolled material manufacturing equipment 120 having two coil unwinding devices 21*a*, 21*b*, two entry-side coil cars 26*a*, 26*b*, and a coil winding device 24 which is a carrousel reel, as shown in FIG. 12, or cold rolled material manufacturing equipment 210 having two coil unwinding devices 21*a*, 21*b*, two entry-side coil cars 26*a*, 26*b*, two tension reels (coil winding devices) 201*a*, 201*b* and two exit-side coil cars 202*a*, 202*b* as shown in FIG. 13, in accordance with the production volume. Thus, there is need to lower the exit-side rolling speed at the time of cutting only to a value of the order of 150 mpm, so that a decrease in the annual production volume can be prevented.

Figure 14:
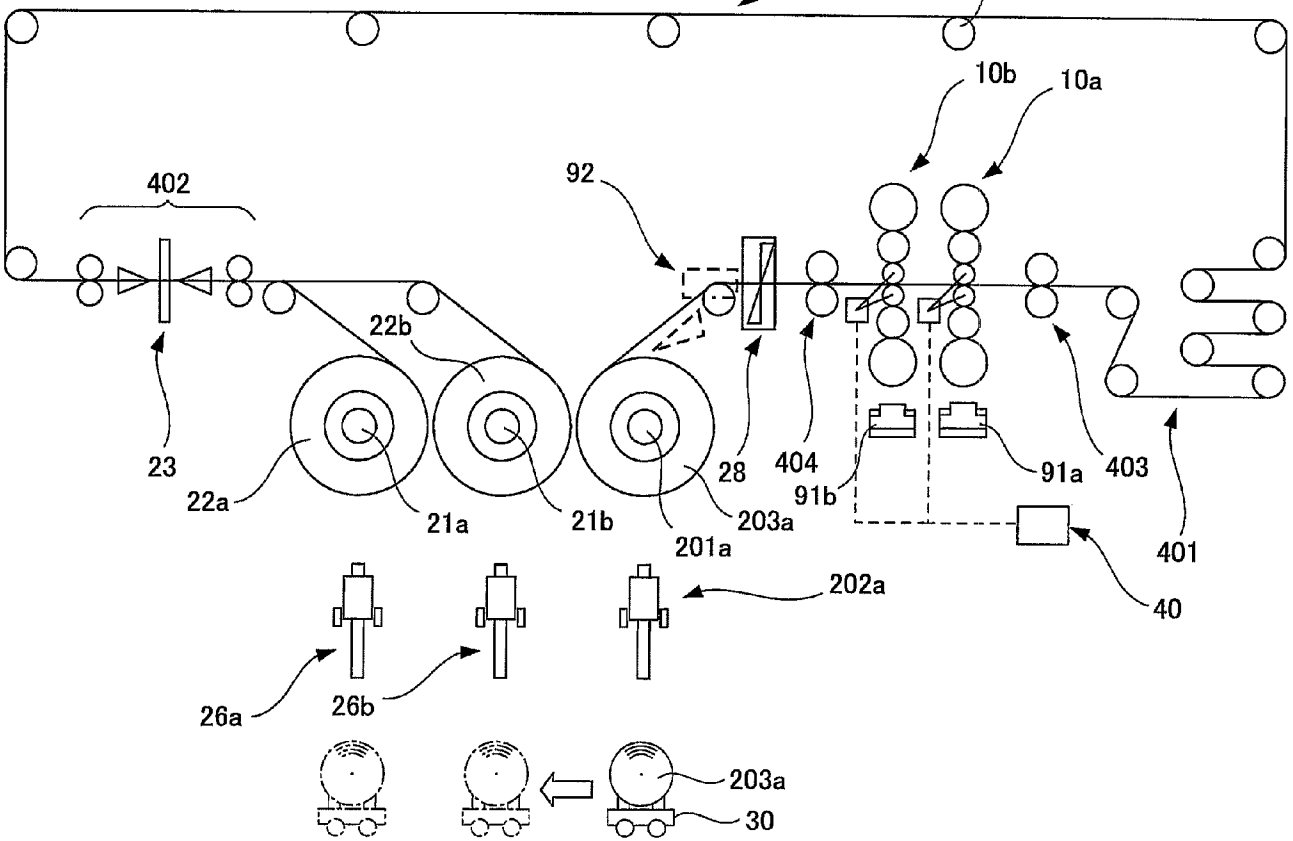
FIG. 14 is a schematic view of cold rolled material manufacturing equipment according to another embodiment of the present invention.

Descriptions have been offered using the cold rolled material manufacturing equipment 200 having two coil unwinding devices 21*a*, 21*b* and two coil winding devices 201*a*, 201*b* which are disposed apart from each other. As shown in FIG. 14, however, there may be cold rolled material manufacturing equipment 400 having two coil unwinding devices 21*a*, 21*b* and one coil winding device 201*a* disposed in proximity, a joining device 23, a snaking control device (coil storage device) 401, a first rolling mill 10*a*, a second rolling mill 10*b*, and a strip cutting device 28 disposed in this order, tension generating devices 402 disposed on the entry side and exit side of the joining device 23, tension generating devices 403 and 404 disposed on the entry side of the first rolling mill 10*a* and the exit side of the second rolling mill 10*b*, and a plurality of guide rollers 405 arranged above these devices, in which a strip S having passed through the joining device 23 is passed above these devices. Alternatively, as shown in FIG. 15, there may be cold rolled material manufacturing equipment 410 having one rolling mill 10*a* in the above cold rolled material manufacturing equipment 400.

The cold rolled material manufacturing equipment 400 or 410 constructed as above can show the same actions and effects as those of the aforementioned rolled steel plate manufacturing equipment 200, and can downsize a coil transport device 30 which transports the coil from the coil winding device 201*a* to the coil unwinding device 21*a* or 21*b*.

By disposing the tension generating devices 403 and 404 on the entry side of the first rolling mill 10*a* and on the exit side of the second rolling mill 10*b*, it becomes possible to minimize tension imposed on the strip from the coil unwinding devices 21*a*, 21*b* to the tension generating device 403 and from the tension generating device 404 to the coil winding device 201*a*. Since the strip can be passed under low tension through the equipment on the entry side and exit side of the tension generating devices 403, 404, the equipment can be rendered lightweight. Since tension can be reduced, moreover, snaking control exercised by the snaking control device 401 is facilitated.

The cold rolled material manufacturing equipment according to the present embodiment, therefore, obtains the following effects:

The cold rolling method according to the present invention comprises a joining step of joining the tail end of a preceding coil to the leading end of a succeeding coil by a joining device disposed on the exit side of an unwinding device for unwinding a hot rolled coil after acid pickling, the succeeding coil having been unwound from the unwinding device; a rolling step of continuously rolling the coils, with the leading end and the tail end of the coils being joined, in one direction by a rolling mill or a plurality of rolling mills; a cutting step of cutting a rolled strip to a desired length by a cutting device disposed between the rolling mill and a winding device; a winding step of winding the rolled coil by the winding device; and a transport step of withdrawing the coil from the winding device and transporting the withdrawn coil to the unwinding device, and is characterized in that in the joining step, the rolling speed during joining of the tail end of the preceding coil to the leading end of the succeeding coil is rendered lower than a steady rolling speed, and that these steps are repeated a plurality of times until the coil reaches a desired product strip thickness. Because of these features, the tiresome passage work and the unrolled portion in the first pass and the second pass, which are disadvantages of the RCM equipment, can be eliminated, and the off-gage rate of the order of about 2.5% to 6.0% can be decreased to about 1.0% or less, a level close to the levels of the TOM equipment and the PL-TCM equipment. Furthermore, the continuous operation can markedly increase the production volume by adopting the compact equipment configuration. Also, the personnel necessary for the plate passage operation can be cut down. Besides, the restrictions on the number of times rolling is performed are eliminated. Nor is the unrolled portion present. Accordingly, plates of various strip thicknesses and steel types can be rolled in high yields, producing the advantage that high efficiency manufacturing can be achieved in comparison with the existing rolling equipment.

In addition to the above-mentioned effects, the rolling speed during joining of the tail end of the preceding coil to the leading end of the succeeding coil is in excess of 0 mpm, but not more than 50 mpm. Thus, the strip storage device can be downsized, and the entire length of the equipment can be shortened.

In addition to the above effects, if the strip thickness ratio between the tail end of the preceding coil and the leading end of the succeeding coil to be joined exceeds 1:1.5, or if the strip thickness difference between these coils exceeds 1 mm, the amount of rolling reduction at the junction and in the vicinity of the junction is rendered smaller than the amount of rolling reduction at the steady rolling portion by on-the-fly gage changing. In addition, the rolling speed at the junction and in the vicinity of the junction is set to exceed 0 mpm, but be not higher than 50 mpm. By these measures, impact load during rolling of the junction can be diminished, the probability of breakage of the plate during rolling of the junction can be decreased, and flaws in the work roll can be suppressed.

In addition to the above effects, if the amount of rolling reduction at the junction exceeds a predetermined value, the amount of rolling reduction at the junction and in the vicinity of the junction is rendered less than the amount of rolling reduction in a steady rolling area by on-the-fly gage changing. By this feature, the probability of breakage of the plate at the junction can be decreased. Also, the rolling speed at the junction and in the vicinity of the junction is allowed to exceed 0 mpm, but be not higher than 50 mpm. By so doing, the range of changes in the product strip thickness in the vicinity of the junction caused by gage changing of the junction can be narrowed to increase the yield.

In addition to the above effects, after or simultaneously with withdrawal of the tail end of the preceding coil from the unwinding device, the rolling speed is rendered a desired speed or lower, and the succeeding coil is inserted into the unwinding device, is unwound at a higher speed than the above rolling speed, is allowed to catch up with the preceding coil at the joining device, and until joining of these coils is completed, the above rolling speed is maintained, and the strip stored beforehand in the strip storage device disposed between the unwinding device and the rolling mill is paid out. Because of this feature, there can be provided equipment which can perform continuous rolling and manufacturing using the single unwinding device, is inexpensive and gives a high yield.

In addition to the above effects, after or at the same time that the strip is cut by the cutting device, the rolling speed is rendered equal to or lower than a desired speed, the coil is withdrawn from the winding device, and the leading end of a succeeding coil is guided to the winding device by the guide device disposed between the cutting device and the winding device. Because of this feature, there can be provided equipment which can perform continuous rolling and manufacture using the single winding device, is inexpensive and gives a high yield.

In addition to the above effects, the rolling speed on the entry side of the rolling mill, the strip thickness on the entry side of the rolling mill, and the rolling speed on the exit side of the rolling mill are measured; the strip thickness directly below the work roll of the rolling mill is computed based on the measured values of the measurements; and the strip thickness is controlled to a desired strip thickness by the hydraulic roll gap control device which the rolling mill has. According to the method of measuring the exit-side strip thickness, and modifying the strip thickness, the accuracy of gage control during low speed rolling declines. By contrast, the present invention can increase the product yield without lowering the gage control accuracy during low speed rolling.

In addition to the above effects, the strip shape is controlled by one of or both of roll bender control and coolant control based on the results of computation of roll deflection due to a change in the rolling load of the rolling mill. According to this feature, in addition to the effects of any one of the aforementioned first to eighth aspects, the accuracy of shape control during low speed rolling and the yield of the product can be increased, as contrasted with the method of measuring the exit-side shape and modifying the shape, which leads to a deteriorated shape control accuracy during low speed rolling.

In addition to the above effects, tension, which has been generated by the tension generating devices disposed on the entry side and the exit side of the rolling mill, is incorporated into gage control to exercise tension control so as to attain the desired strip thickness. Because of this feature, the amount of an increase in the rolling load due to an increase in the coefficient of friction during low speed rolling can be curbed by tension control. Thus, it becomes possible to obtain the desired strip thickness in low speed rolling, without increasing the rated rolling load of the rolling mill.

In addition to the above effects, a plurality of the coils are joined in the first pass to form a built-up coil; the built-up coil is rolled in the second pass to the pass before the final pass, without being divided into a desired coil length; and the rolled built-up coil is divided into the desired coil length in the final pass by the cutting device disposed on the exit side of the rolling mill. This feature makes it possible to cut down on the number of times joining is performed, the number of times cutting is performed, and the number of the coils circulated, so that the manufacturing efficiency can be increased.

In addition to the above effects, the equipment of the present invention comprises the unwinding device for unwinding a hot rolled coil after acid pickling; the joining means, disposed on the exit side of the unwinding device, for joining the tail end of a preceding coil to the leading end of a succeeding coil unwound from the unwinding device; the single rolling mill or a plurality of the rolling mills for continuously rolling the coils, with the leading end of the coil and the tail end of the coil being joined, in one direction; the strip storage device, disposed between the joining means and the rolling mill, for storing a strip in order to perform continuous rolling by the rolling mill during joining of the preceding coil and the succeeding coil by the joining means; the strip cutting device, disposed on the exit side of the rolling mill, for cutting the strip to a desired length; the winding device for winding the rolled coil; transport means for withdrawing the coil from the winding device, and transporting the coil to the unwinding device so that the coil is rolled a plurality of times until the strip thickness of the coil reaches a desired product strip thickness; and a rolling speed control device for controlling the rolling speed during joining of the tail end of the preceding coil to the leading end of the succeeding coil to a lower speed than a steady rolling speed. According to this feature, the manufacturing equipment of the present invention can be provided.

In addition to the above effects, the rolling speed control device is a control device capable of controlling the rolling speed to a rolling speed which exceeds 0 mpm, but is not higher than 50 mpm. According to this feature, compact equipment can be provided inexpensively.

In addition to the above effects, the strip storage device stores the strip with a length of 100 m or less. According to this feature, compact equipment can be provided inexpensively.

In addition to the above effects, the tension generating devices are disposed on the entry side and the exit side of the rolling mill. According to this feature, the amount of an increase in the rolling load during low speed rolling can be curbed, and the upsizing of the rolling mill can be prevented.

In addition to the above effects, the rolling mill is a six-high mill. According to this feature, even if the rolling load increases with an increase in the coefficient of friction during low speed rolling, changes in the strip shape can be suppressed, and the yield of the products can be increased. Moreover, the work roll diameter can be rendered small to curb the amount of the increase in the rolling load.

In addition to the above effects, the unwinding device and the winding device are disposed adjacently. According to this feature, the duration of coil transport from the winding device to the unwinding device can be shortened, and the transport distance can be shortened. Thus, the coil transport device can be downsized.

In addition to the above effects, two of the unwinding devices are provided. According to this feature, the unwinding operation can be expedited to increase the production volume.

In addition to the above effects, the single unwinding device is provided, and the rolling speed control device is a control device which, while paying out the strip stored beforehand in the strip storage device, controls the rolling speed to a speed exceeding 0 mpm, but not higher than 50 mpm, from a time when the tail end of the preceding coil departs from the unwinding device until the succeeding coil inserted into the unwinding device is unwound at a higher speed than the above rolling speed, and joining of the preceding coil and the succeeding coil by the joining device is completed. Thus, continuous rolling and manufacture become possible, and continuous manufacture equipment with high yield can be provided at low cost.

In addition to the above effects, the equipment of the present invention further comprises the winding device as a single device; the coil withdrawing device, disposed in the vicinity of the winding device, for withdrawing the coil from the winding device; and the strip guide device, disposed between the strip cutting device and the winding device, for guiding the leading end of the succeeding coil to the winding device, and the rolling speed control device being a control device for controlling the rolling speed to a speed exceeding 0 mpm, but not higher than 50 mpm, from a time when the strip is cut by the strip cutting device until the leading end of the succeeding coil is guided to the winding device by the strip guide device. Thus, continuous rolling and manufacture become possible, and continuous manufacture equipment with high yield can be provided at low cost.

In addition to the above effects, the winding device is a carrousel reel or two tension reels. Thus, a high speed winding operation can be performed to increase the production volume.

In addition to the above effects, the joining device is MSW, if the strip thickness of the strip is 4.5 mm or less. According to this feature, the single joining device can achieve joining of plates from 0.1 mm to 4.5 mm thick at low cost, while ensuring the reliability of the junction. In connection with the decreased strength of the junction after rolling, which has been regarded as a conventional drawback, reliability of the joining strength is not impaired, but stable operation can be realized, by working on the method of rolling the junction.

If the cold rolled material is a non-ferrous metal such as an aluminum alloy, a copper alloy, or a magnesium alloy, the joining device is a friction stir welder. According to this feature, joining with high reliability of strength can be performed inexpensively.

In addition to the above effects, two of the rolling mills are provided. According to this feature, a volume of the order of 600,000 to 900,000 tons can be produced annually, and the number of times the coil is circulated can be decreased. Besides, during low speed rolling, the tension of the strip between the rolling mills is enhanced by the output of the main motor for the rolling mills, whereby the amount of an increase in the rolling load associated with an increase in the coefficient of friction between the work roll and the strip can be curbed. Similarly, during steady rolling, the number of times rolling is performed can be decreased by increasing the tension of the strip between the rolling mills.

The invention claimed is:

1. Cold rolled material manufacturing equipment, comprising:

an unwinding device for unwinding a hot rolled coil after acid pickling;

a joining device, disposed on an exit side of the unwinding device, for joining a tail end of a preceding coil to a leading end of a succeeding coil unwound from the unwinding device;

at least one rolling mill for continuously rolling the coils, with the leading end of the coil and the tail end of the coil being joined, in one direction;

a strip storage device, disposed between the joining device and the at least one rolling mill, for storing a strip in order to perform continuous rolling by the at least one rolling mill during joining of the preceding coil and the succeeding coil by the joining device;

a strip cutting device, disposed on an exit side of the at least one rolling mill, for cutting the strip to a desired length;

a winding device for winding the rolled strip;

a transport device for withdrawing the coil from the winding device, and transporting the withdrawn coil to the unwinding device so that the coil is rolled a plurality of times until a strip thickness of the coil reaches a desired product strip thickness; and a rolling speed control device for controlling a rolling speed during joining of the tail end of the preceding coil to the leading end of the succeeding coil to a lower speed than a steady rolling speed, wherein the strip cutting device is disposed on the exit side of a rolling mill, among the at least one rolling mill, provided furthest downstream with respect to a transporting direction of the withdrawn coil.

2. The cold rolled material manufacturing equipment according to claim 1, wherein the rolling speed control device is a control device capable of controlling the rolling speed to a rolling speed which exceeds 0 mpm, but is not higher than 50 mpm.

3. The cold rolled material manufacturing equipment according to claim 2, wherein the strip storage device stores the strip with a length of 100 m or less.

4. The cold rolled material manufacturing equipment according to claim 2, wherein tension generating devices are disposed on an entry side of a rolling mill, among the at least one rolling mill, provided furthest upstream with respect to the transporting direction, and the exit side of the rolling mill provided furthest downstream.

5. The cold rolled material manufacturing equipment according to claim 2, wherein the at least one rolling mill is a six-high mill.

6. The cold rolled material manufacturing equipment according to claim 2, wherein the unwinding device and the winding device are disposed adjacently.

7. The cold rolled material manufacturing equipment according to claim 2, wherein two of the unwinding devices are provided.

8. The cold rolled material manufacturing equipment according to claim 2, wherein the unwinding device is a single unwinding device, and the rolling speed control device is a control device which controls the rolling speed to a speed exceeding 0 mpm, but not higher than 50 mpm, from a time when the tail end of the preceding coil departs from the unwinding device until the succeeding coil inserted into the unwinding device is unwound at a higher speed than the rolling speed, and joining of the preceding coil and the succeeding coil by the joining device is completed, with the strip stored beforehand in the strip storage device being paid out.

9. The cold rolled material manufacturing equipment according to claim 2, further comprising:

the winding device as a single winding device, a coil withdrawing device, disposed in the vicinity of the winding device, for withdrawing the coil from the winding device, and a strip guide device, disposed between the strip cutting device and the winding device, for guiding a leading end of a succeeding coil to the winding device, and wherein the rolling speed control device is a control device for controlling the rolling speed to a speed exceeding 0 mpm, but not higher than 50 mpm, from a time when the strip is cut by the strip cutting device until the leading end of the succeeding coil is guided to the winding device by the strip guide device.

10. The cold rolled material manufacturing equipment according to claim 2, wherein the winding device is a carrousel reel or two tension reels.

11. The cold rolled material manufacturing equipment according to claim 2, wherein the joining device is a mash seam welder, if a strip thickness of the strip is 4.5 mm or less.

12. The cold rolled material manufacturing equipment according to claim 2, wherein if the cold rolled material is a non-ferrous metal such as an aluminum alloy, a copper alloy, or a magnesium alloy, the joining device is a friction stir welder.

13. The cold rolled material manufacturing equipment according to claim 2, wherein two rolling mills are provided.

14. The cold rolled material manufacturing equipment according to claim 1, wherein the strip storage device stores the strip with a length of 100 m or less.

15. The cold rolled material manufacturing equipment according to claim 1, wherein tension generating devices are disposed on an entry side of a rolling mill, among the at least one rolling mill, provided furthest upstream with respect to the transporting direction, and the exit side of the rolling mill provided furthest downstream.

16. The cold rolled material manufacturing equipment according to claim 1, wherein the at least one rolling mill is a six-high mill.

17. The cold rolled material manufacturing equipment according to claim 1, wherein the unwinding device and the winding device are disposed adjacently.

18. The cold rolled material manufacturing equipment according to claim 1, wherein two of the unwinding devices are provided.

19. The cold rolled material manufacturing equipment according to claim 1, wherein the unwinding device is a single unwinding device, and the rolling speed control device is a control device which controls the rolling speed to a speed exceeding 0 mpm, but not higher than 50 mpm, from a time when the tail end of the preceding coil departs from the unwinding device until the succeeding coil inserted into the unwinding device is unwound at a higher speed than the rolling speed, and joining of the preceding coil and the succeeding coil by the joining device is completed, with the strip stored beforehand in the strip storage device being paid out.

20. The cold rolled material manufacturing equipment according to claim 1, further comprising:

the winding device as a single winding device, a coil withdrawing device, disposed in the vicinity of the winding device, for withdrawing the coil from the winding device, and a strip guide device, disposed between the strip cutting device and the winding device, for guiding a leading end of a succeeding coil to the winding device, and wherein the rolling speed control device is a control device for controlling the rolling speed to a speed exceeding 0 mpm, but not higher than 50 mpm, from a time when the strip is cut by the strip cutting device until the leading end of the succeeding coil is guided to the winding device by the strip guide device.

21. The cold rolled material manufacturing equipment according to claim 1, wherein the winding device is a carrousel reel or two tension reels.

22. The cold rolled material manufacturing equipment according to claim 1, wherein the joining device is a mash seam welder, if a strip thickness of the strip is 4.5 mm or less.

23. The cold rolled material manufacturing equipment according to claim 1, wherein if the cold rolled material is a non-ferrous metal such as an aluminum alloy, a copper alloy, or a magnesium alloy, the joining device is a friction stir welder.

24. The cold rolled material manufacturing equipment according to claim 1, wherein two rolling mills are provided.

* * * * *